US010889105B2

(12) United States Patent
Gatti

(10) Patent No.: US 10,889,105 B2
(45) Date of Patent: Jan. 12, 2021

(54) APPARATUS AND PROCESS FOR PREPARING A FLEXOGRAPHIC PRINTING SLEEVE

(71) Applicant: BIESSSE EQUIPMENT SOLUTIONS S.R.L., Sedriano (IT)

(72) Inventor: Roberto Gatti, Sedriano (IT)

(73) Assignee: BIESSSE EQUIPMENT SOLUTIONS S.R.L., Milan (IT)

( * ) Notice: Subject to any disclaimer, the term of this patent is extended or adjusted under 35 U.S.C. 154(b) by 162 days.

(21) Appl. No.: 15/775,411

(22) PCT Filed: Nov. 11, 2016

(86) PCT No.: PCT/IB2016/056788
§ 371 (c)(1),
(2) Date: May 11, 2018

(87) PCT Pub. No.: WO2017/081642
PCT Pub. Date: May 18, 2017

(65) Prior Publication Data

US 2018/0333950 A1 Nov. 22, 2018

(30) Foreign Application Priority Data

Nov. 11, 2015 (IT) ..... 102015000071687

(51) Int. Cl.
*B41F 27/14* (2006.01)
*B41F 27/12* (2006.01)
*B41F 27/00* (2006.01)

(52) U.S. Cl.
CPC ..... *B41F 27/1206* (2013.01); *B41F 27/005* (2013.01); *B41F 27/1275* (2013.01);
(Continued)

(58) Field of Classification Search
CPC .... B41F 27/005; B41F 27/12; B41F 27/1206; B41F 27/1275; B41F 27/14; B41P 2227/10; B41P 2227/11; B41P 2227/21
See application file for complete search history.

(56) References Cited

U.S. PATENT DOCUMENTS 3,873,202 A 3/1975 Inoue
5,132,911 A 7/1992 Leader, Jr. et al.
(Continued)

FOREIGN PATENT DOCUMENTS

DE 296 14 107 U1 1/1997
DE 199 29 630 A1 1/2001
(Continued)

OTHER PUBLICATIONS

Italian Search Report Corresponding to UB20155461 dated Aug. 9, 2016.
(Continued)

*Primary Examiner* — Leslie J Evanisko
(74) *Attorney, Agent, or Firm* — Davis & Bujold PLLC; Michael J. Bujold

(57) ABSTRACT

An apparatus (1) for preparing a flexographic printing sleeve (3) comprises a support structure (21), comprising first support mechanism (2) which defines a workstation for rotatably supporting a first flexographic printing sleeve (3) such that it can rotate about a preset axis (K-K), a roll (11) of double-sided adhesive tape rotatably supported by a second support mechanism (10), and a first feeding and guiding mechanism (13) for unwinding the double-sided adhesive tape (12) from the roll (11) and directing the double-sided adhesive tape (12) to the surface of the first sleeve (3).

32 Claims, 13 Drawing Sheets

(52) U.S. Cl.
CPC ..... *B41F 27/14* (2013.01); *B41P 2227/10* (2013.01); *B41P 2227/11* (2013.01); *B41P 2227/21* (2013.01)

(56) References Cited

U.S. PATENT DOCUMENTS

| | | | | |
|---|---|---|---|---|
| 6,055,908 | A | 5/2000 | Van Der Horst | |
| 6,273,166 | B1 | 8/2001 | Roosen | |
| 2007/0261580 | A1* | 11/2007 | Otten ..... | B41F 27/12 101/477 |
| 2012/0272848 | A1 | 11/2012 | Leader, Jr. et al. | |
| 2015/0231876 | A1 | 8/2015 | Kasper et al. | |
| 2016/0159079 | A1 | 6/2016 | Von Heesen et al. | |

FOREIGN PATENT DOCUMENTS

| | | | |
|---|---|---|---|
| DE | 10 2013 107 470 | A1 | 1/2015 |
| EP | 1 435 291 | A1 | 7/2004 |
| EP | 1 727 677 | B1 | 12/2008 |
| EP | 2 535 188 | A1 | 12/2012 |
| WO | 2014/029527 | A1 | 2/2014 |

OTHER PUBLICATIONS

International Search Report Corresponding to PCT/IB2016/056788 datd Feb. 2, 2017.
Italian Written Opinion Corresponding to UB20155461 dated Aug. 9, 2016.
Written Opinion Corresponding to PCT/IB2016/056788 dated Feb. 2, 2017.

* cited by examiner

APPARATUS AND PROCESS FOR PREPARING A FLEXOGRAPHIC PRINTING SLEEVE

This application is a National Stage completion of PCT/IB2016/056788 filed Nov. 11, 2016, which claims priority from Italian patent application serial no. 102015000071687 filed Nov. 11, 2015.

SUMMARY OF THE INVENTION

The present invention relates to an apparatus for preparing a flexographic printing sleeve.

In a further aspect, the invention relates to an apparatus for application of photopolymers to a flexographic printing sleeve.

In flexographic printing, printing machines are known in the art, which use photopolymers applied to the surface of flexographic printing sleeves with the interposition of double-sided adhesive tapes.

The outer surface of the flexographic printing sleeve must be covered beforehand with a double-sided adhesive tape, and the photopolymers may be applied to the sleeve only at a later time.

It should be noted that the printing sleeve consists of a cylindrical tubular element having a circular section and a preset axis, which is designed to be engaged by a gripping spindle of the sleeving machine to be rotated about its axis.

As used herein:

- the term photopolymer is generally used to designate the printing plate, sometimes referred to as "printing block", which is made of a soft and elastically deformable material, and
- a photopolymer applied to the outer surface of a flexographic printing sleeve is intended to be applied not by direct contact, but with the interposition of a double-sided adhesive tape.

In flexographic printing, handling and especially proper application of photopolymers to the outer surface of the flexographic printing sleeve is essential for good-quality printing. Even an error of a few tenths of a millimeter in the application of the photopolymers to the flexographic printing sleeve will cause an appreciable degradation of the quality of successive prints.

In this respect it shall be noted that proper application of photopolymers to flexographic printing sleeves is strictly dependent on an optimal application of the double-sided adhesive to the surface of the flexographic printing sleeve, as any gap more than half a millimeter between adjacent edges of the adhesive tape will cause an appreciable degradation of the quality of the successive prints.

At present, flexographic printing sleeves are prepared by an operator that manually covers each sleeve designed to act as a support for photopolymers with double-sided adhesive tape.

Also, the highly deformable nature of photopolymers will require them to be positioned on flexographic printing sleeves using machines, although the latter have the drawback of being too structurally and functionally complex to ensure proper positioning of photopolymers.

Therefore, there is a strong need in the art for a machine for preparing flexographic printing sleeves that is structurally and functionally simple while ensuring highly accurate positioning.

Concerning the application of the double-sided tape to a flexographic printing sleeve it shall be noted that the width of the double-sided adhesive is generally smaller, typically an integer submultiple of the width of the axial section of the surface of the flexographic printing sleeve, and the such double-sided adhesive tape must be applied with a perfect axial juxtaposition of the various sections of double-sided adhesive tape placed one next to the other.

This invention is based on the issue of providing an apparatus for preparing a flexographic printing sleeve that has such structural and functional characteristics as to fulfill the aforementioned needs, while obviating the above prior art drawbacks.

This problem is solved by an apparatus for preparing a flexographic printing sleeve as defined in the independent claim(s).

According to another aspect, the problem is solved by an apparatus for application of photopolymers to a flexographic printing sleeve and a process of application of photopolymers to a flexographic printing sleeve.

BRIEF DESCRIPTION OF THE DRAWINGS

Further characteristics and advantages of the apparatus and process of present invention will be apparent from the following description of a few preferred embodiments thereof, which are given by way of illustration and without limitation with reference to the accompanying figures, in which.

DETAILED DESCRIPTION OF THE PREFERRED EMBODIMENTS

Figure 1:
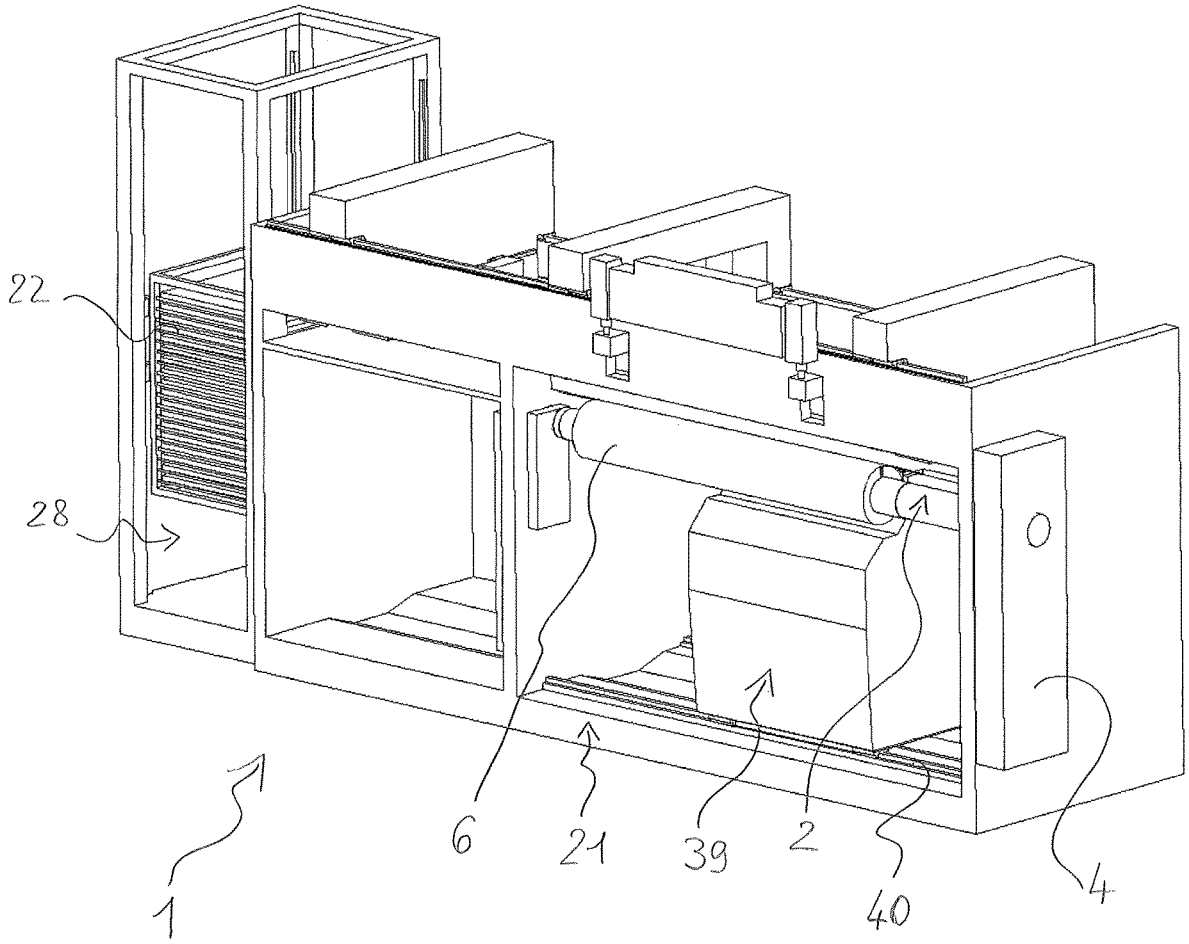
FIG. 1 shows a simplified perspective view of an apparatus for preparing a flexographic printing sleeve of the invention.
Figure 2:
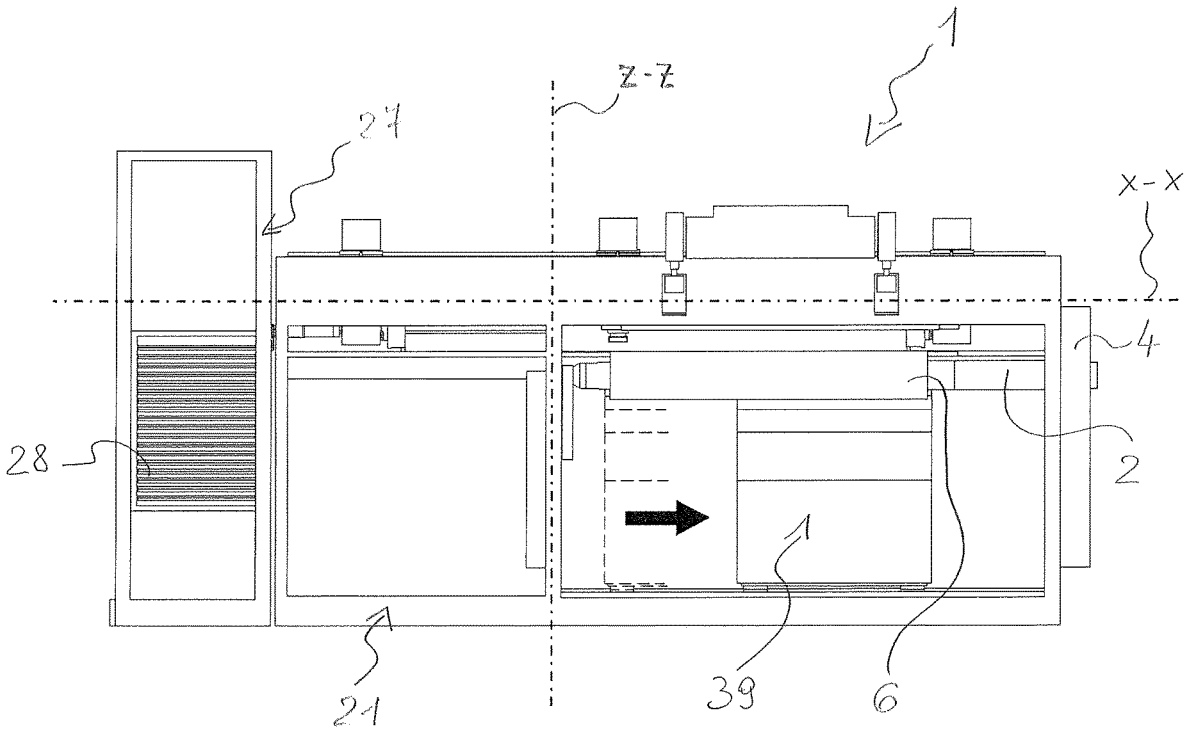
FIG. 2 shows a front view of the machine of FIG. 1.

Referring to the accompanying figures, numeral 1 generally designates an apparatus for preparing a flexographic printing sleeve 3 of the invention.

The apparatus 1 comprises a support structure 21 which, according to the illustrated embodiment, defines a substantially parallelepiped body having a rectangular plan shape extending in a longitudinal direction X-X between opposed ends.

According to a preferred embodiment, as described hereinbelow, the apparatus 1 is not only able to cover the outer surface of the flexographic printing sleeves, as is better explained below, but can also automatically apply one or more photopolymers to the flexographic printing sleeve immediately after the application of the double-sided adhesive tape. For this purpose, the apparatus 1 of the illustrated embodiment comprises:

first support means 2, which define a workstation for rotatably supporting a first flexographic printing sleeve 3 having a preset axis K-K, to allow said first sleeve 3 to rotate about its axis K-K, relative to the aforementioned support structure 21;

first motor means 4 associated with said first support means 2, for rotating said first sleeve 3 supported in said workstation, about its axis;

a support surface 5 having a top side upon which a first photopolymer 6 to be applied to said sleeve 3 supported in said workstation is designed to be positioned, wherein said support surface 5 comprises:

a loading area whereat the first photopolymer 6 to be applied to the first sleeve 3 supported in the aforementioned workstation is initially positioned for detection and an unloading area wherefrom said first photopolymer 6 is directed toward the first sleeve 3 supported in the aforementioned workstation, the unloading area being distal from the loading area;

first handling means 7 for moving and orienting the aforementioned first photopolymer 6 on the support surface 5 from the loading area to the unloading area and first detection means 8*a*, 8*b* for detecting the presence as well as the position and orientation of a photopolymer 6 at the aforementioned loading area of the support surface 5.

According to the illustrated embodiment, the aforementioned first support means 2 that define a workstation to rotatably support a first sleeve 3 comprise a motor-driven spindle, for supporting and rotating said first sleeve 3 about its axis.

Therefore, the top side of the support surface 5 is designed to form the base surface for the photopolymers 6 as they are being handled, i.e. displaced by the first handling means 7.

As shown in the figures, the support surface 5 is a horizontal surface that is jointly supported by the support structure 21 and extends longitudinally in the direction X-X between the opposed ends of the support structure 21, and transversely in a direction Y-Y perpendicular to the longitudinal direction X-X.

The loading area of the support surface 5 is placed proximate to a first end of the support structure at which the apparatus 1 comprises a photopolymer-holder 28 adapted to receive one or more separate photopolymers 5 in a lying position.

According to the illustrated embodiment, the aforementioned photopolymer-holder 28 is defined by tray unit having a plurality of superimposed trays 22, each being adapted to receive a respective photopolymer 6.

The apparatus 1 further comprises pick-up means 29 for selectively picking up said one or more photopolymers 6 from said photopolymer-holder 28 and carrying the photopolymer 6 that has picked up into the aforementioned loading area.

It shall be noted that the trays 22 of the tray unit 28 can be moved in a direction Z-Z perpendicular to the support surface 5, such that each tray 22 may be selectively placed at the same height as the top surface of the support surface 5 to allow the pick-up means, i.e. a motor-driven gripper 29 to pick up the respective photopolymer contained in such tray.

In this example, the unloading area of the support surface 5 substantially faces the front side of the support structure 21 and extends in the aforementioned longitudinal direction X-X substantially from the second end of the support structure 21.

The aforementioned workstation at which the first sleeve 3 is rotatably supported extends frontally in the aforementioned longitudinal direction X-X to face the loading area, substantially at the same height but in a more external position for a viewer that looks at the machine from the front.

Particularly, the aforementioned workstation comprises a rotating spindle, extending in the longitudinal direction, with the aforementioned first sleeve 3 coaxially mounted thereto to rotate about its axis.

Figure 3:
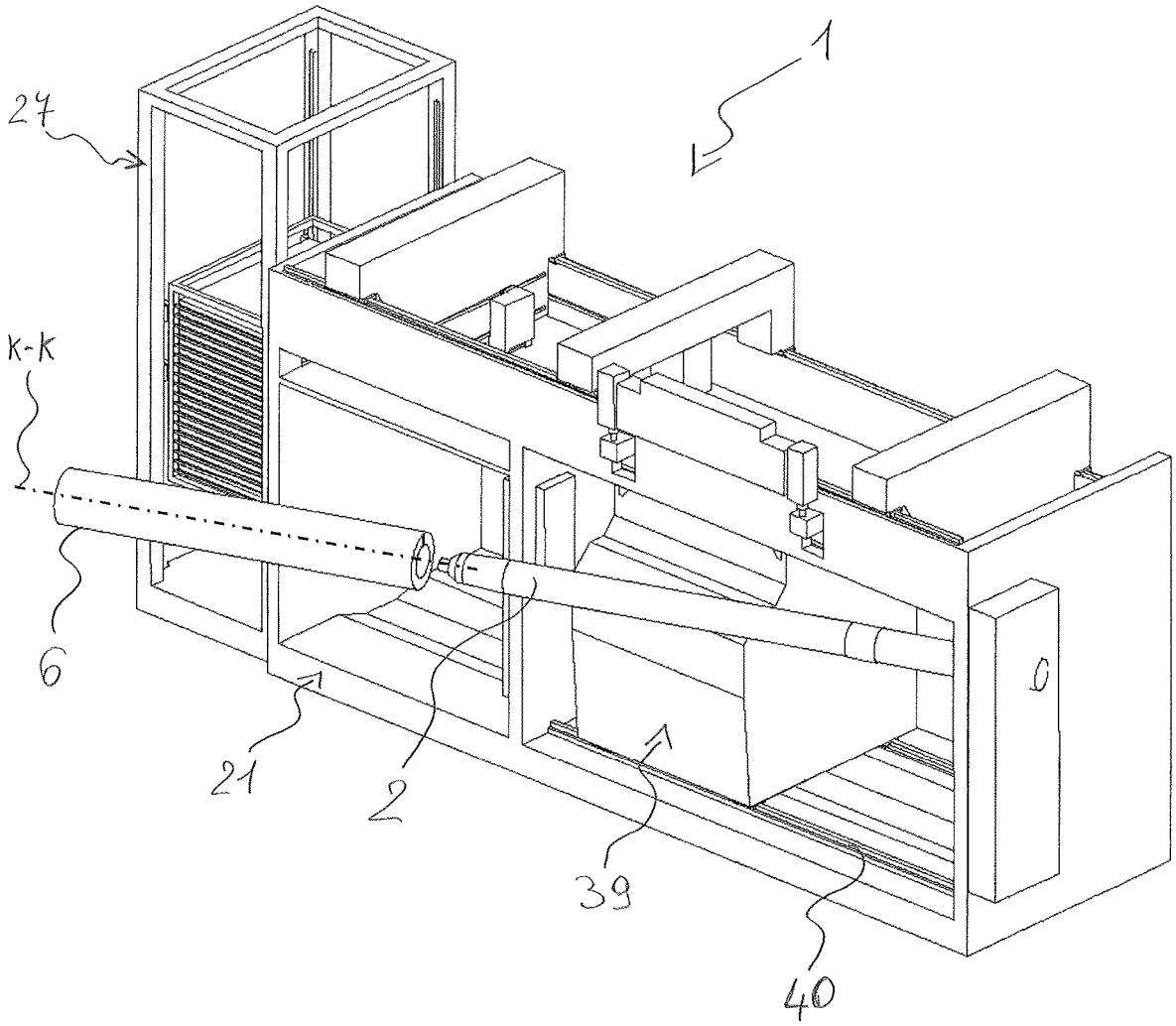
FIGS. 3 and 4 show the views of FIGS. 1 and 2 during a step of insertion/removal of a flexographic printing sleeve.
Figure 4:
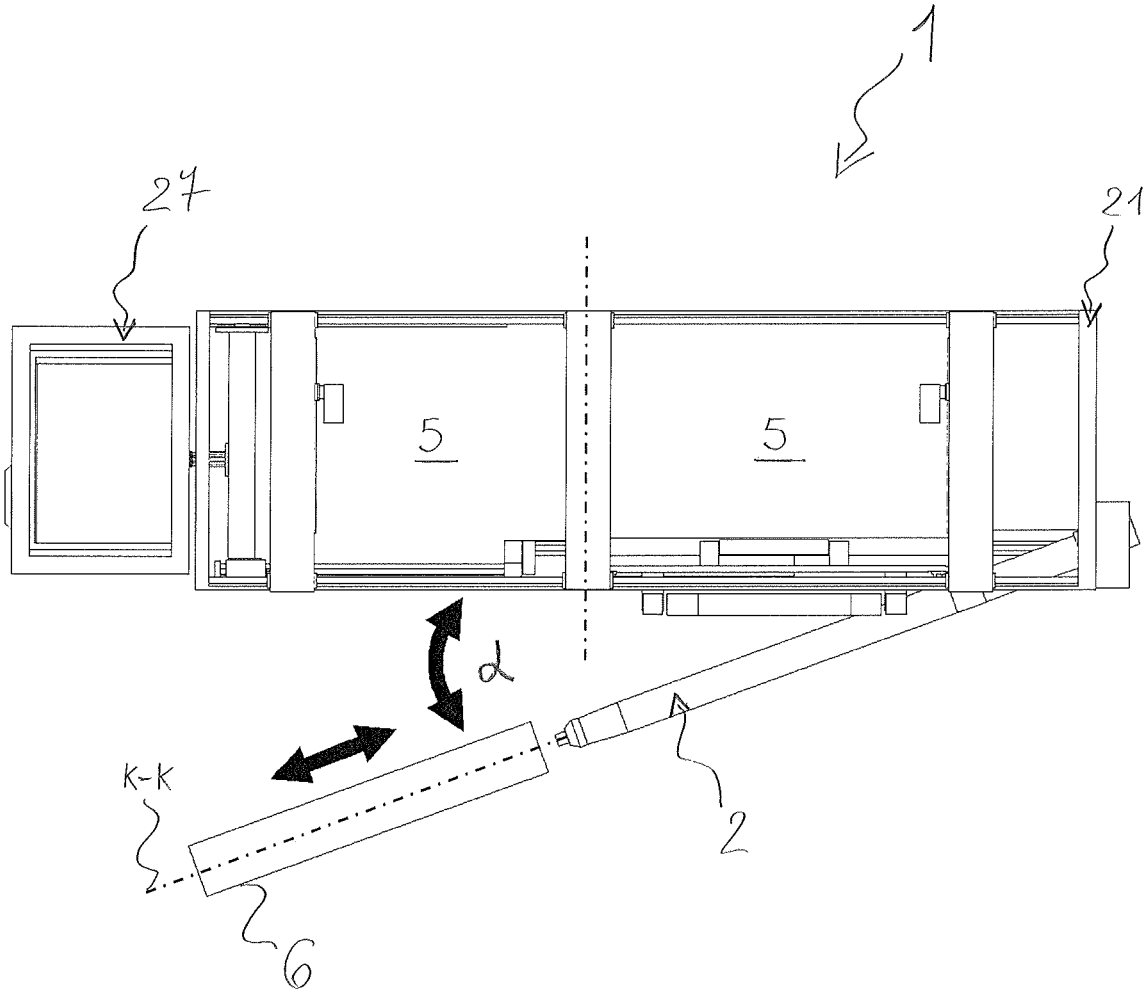

As shown in FIGS. 3 and 4, the spindle 2 is hinged at one end to be rotated by a preset limited angle $\alpha$ relative to the longitudinal axis to allow a sleeve 3 to be loaded/unloaded on/from the spindle.

Preferably the aforementioned first detection means 8*a*, 8*b* comprise a camera, a scanner, a laser detector or optical sensors located in such positions above the support surface 5 as to capture an image of the photopolymer 6 placed on the support surface 5, namely at the loading area.

According to a preferred embodiment, the aforementioned detection means comprise:

first low-definition detection means 8*a*, e.g. a pair of first low-definition cameras 8*a*, for detecting the edges of the first photopolymer 6 positioned in the loading area of said support surface 5 and first high-definition detection means 813, here a pair of second high-definition cameras 8*b*, for detecting and reading, inside the edges of the first photopolymer 6 that has been detected, one or more positioning and centering marks 38 provided on said first photopolymer 6.

Advantageously, the solution of using first low-definition detection means 8*a* and only later additional and independent first high-definition detection means 8*b* can reduce the times to detect the photopolymer 6 and the positioning and centering marks 38 carried thereby while maintaining a high accuracy of the detected positions thereof.

Therefore, as best shown hereinafter, the presence of first low-definition detection means 8*a* and additional distinct high-definition detection means 8*b* advantageously allows the first high-definition means 8*b* to be used to check accurate positioning of the photopolymers 6 applied to the first sleeve 3 placed in said workstation, whereas the first low-definition detection means 8*a* are engaged to detect the edges of the first photopolymer 6 placed in the loading area, which will provide an apparent optimization of the processing means and times of the apparatus 1.

Preferably, said high-definition detection means 8*b* can acquire an image of a portion of the first photopolymer 6 with an accuracy at least one order of magnitude higher than the image that can be acquired by said second low-definition detection means 8*a*.

According to a preferred embodiment, the aforementioned first handling means 7 for moving and orienting the aforementioned first photopolymer 6 on the support surface 5 from the loading area to the unloading area comprise a vacuum gripping manipulator 7 which is supported by the support structure 21 above the support surface 5 to be able to move relative to such support surface 5;

vertically in the direction Z-Z toward/away from said support surface 5, translationally in the directions X-X and Y-Y parallel to the support surface 5 and rotatably about the axis of rotation Z-Z perpendicular to said support surface 5.

For this purpose, the apparatus 2 comprises fourth motor means for actuating said vacuum gripping manipulator relative to said support surface 5 as discussed above, namely toward/away from said support surface 5, for translational movement relative to said support surface 5 and for rotation about said axis of rotation Z-Z perpendicular to said support surface 5.

Therefore, the vacuum gripping manipulator 7 is caused to adhere from above to the surface of the first photopolymer 6 positioned in the loading area of the support surface 5 for exerting a suction action on said first photopolymer 6 and thereby becoming jointly displaceable therewith as it moves on the support surface 5 to the unloading area in the proper position and orientation for application to the sleeve 3 rotatably supported in said workstation.

It should be noted that such suction under vacuum allows the vacuum gripping manipulator 7 to adhere and be jointly displaceable with the first photopolymer 6 placed on the support surface 5, thereby avoiding the need of forcing such photopolymer 6 against the support surface to allow displacement thereof, as required in prior art apparatus.

In short, the suction exerted by the vacuum gripping manipulator 7 causes the underlying photopolymer 6 to be slightly lifted, by a few microns, allowing the photopolymer 6 to be firmly and effectively displaced, under low friction conditions, on the support surface 5.

Preferably, the aforementioned vacuum gripping manipulator 7 has a bottom side which:

faces the top side of the support surface 5, is designed to contact and adhere against the first photopolymer 6 supported on the support surface 5 to cause displacement and rotation thereof from the loading area to the unloading area and comprises a plurality of suction openings, preferably at least ten suction openings, connected to suction means, not shown, of the apparatus 1.

Preferably, the aforementioned bottom side of the vacuum gripping manipulator 7 comprises a middle area, having a surface area of at least 10 cm2, more preferably at least 30 cm2, at which the aforementioned plurality of suction openings are evenly distributed, and a peripheral edge defining a sealing frame. Advantageously, the aforementioned middle area of the vacuum gripping manipulator 7 is a flat surface designed to completely adhere to the surface of the first photopolymer 6 to be displaced, to prevent any local and point-like action on a limited portion of such first photopolymer 6, thereby advantageously preventing such first photopolymer 6 from being deformed as a result of the gripping action of the vacuum gripping manipulator 7, as it would be deformed, for example, if suction cups were used.

Preferably, the aforementioned middle area of the bottom side of the vacuum gripping manipulator 7 comprises a through hole at each opening of the aforementioned plurality of suction openings.

According to a preferred embodiment, the apparatus 1 comprises:

suction and/or blowing means 32, 31 and suction and/or blowing holes 30 formed in the support surface 5 and in fluid communication with said suction and/or blowing means 32, 31 for suction of air from the top side of the support surface 5 or for discharge of blown air out of the top side of said support surface 5.

Figure 7:
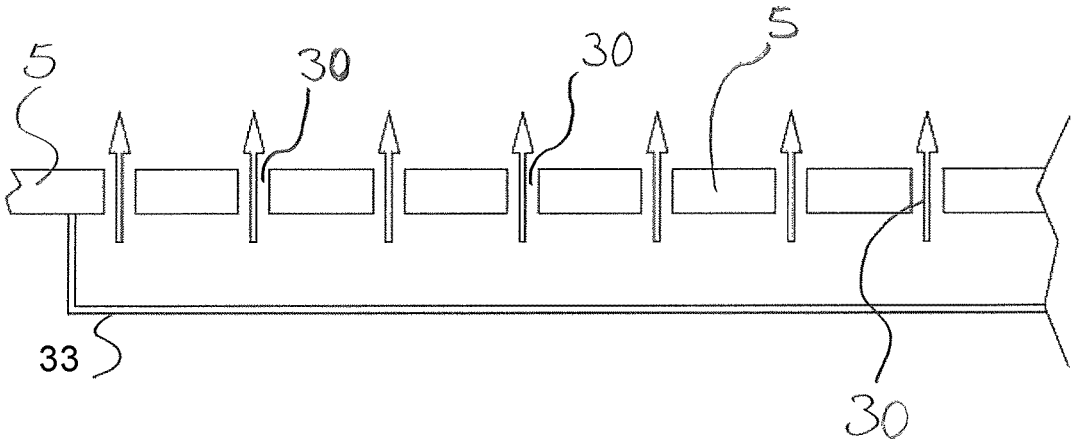
FIG. 7 shows a cross-sectional enlarged view of the support surface of the machine of FIG. 1.

The aforementioned suction and/or blowing means 32, 31 are connected in fluid communication to an air manifold 33 (see FIG. 7), which is sealingly mounted underneath the support surface 5 to be in fluid communication with the suction and/or blowing holes 30 of the support surface 5.

Figure 8:
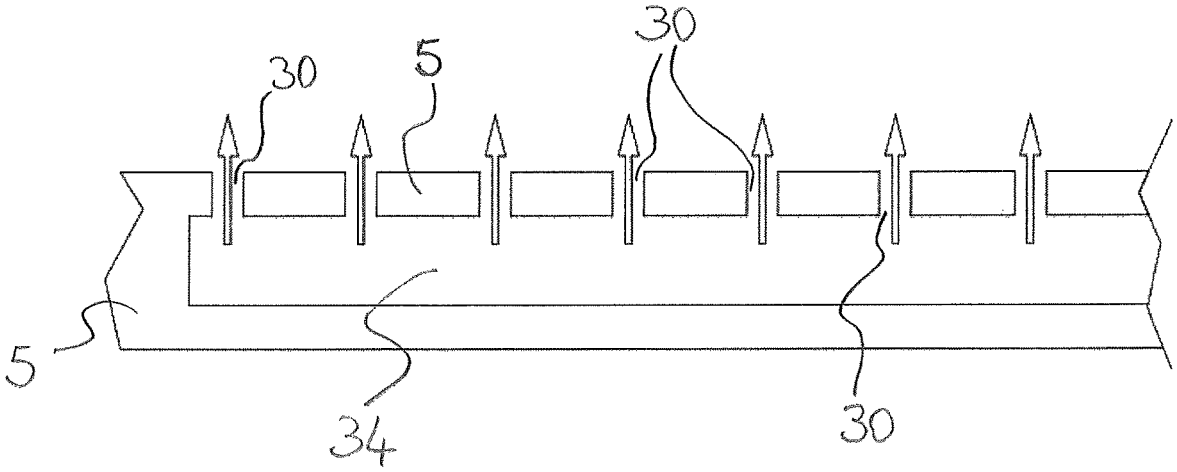
FIG. 8 shows a cross-sectional enlarged view of the support surface of the machine of FIG. 1 according to a variant embodiment.

Conversely, according to the embodiment as shown in FIG. 8, the support surface 5 is a support surface comprising an inner cavity 34, said inner cavity 34 being:

in fluid communication with the aforementioned suction and/or blowing means 32, 31 and delimited at its top by a wall of the support surface 5 comprising the aforementioned suction and/or blowing holes 30.

Figure 13:
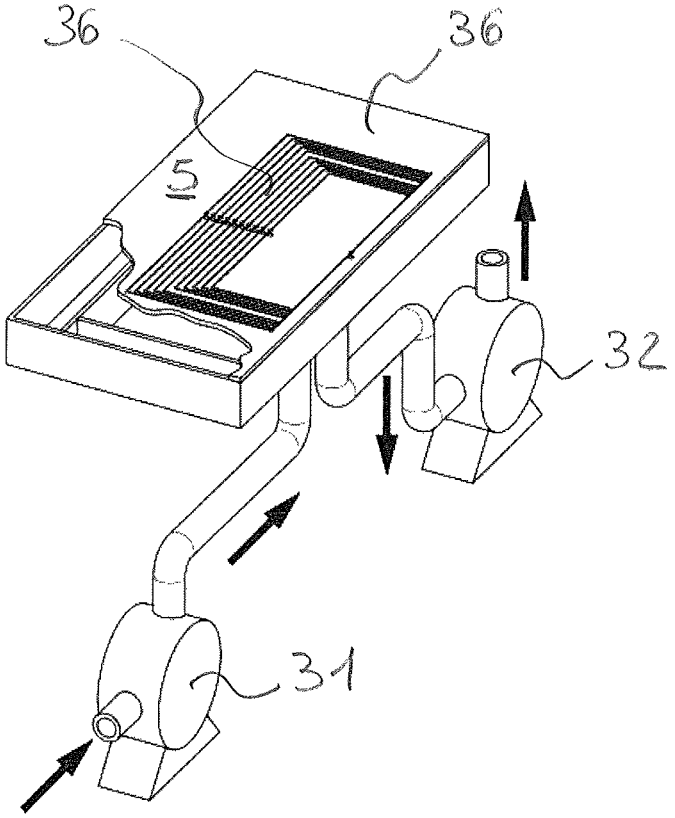
FIG. 13 shows a simplified and partially sectional view of a portion of the support surface of the machine of FIG. 1 and the suction and/or blowing means.
Figure 14:
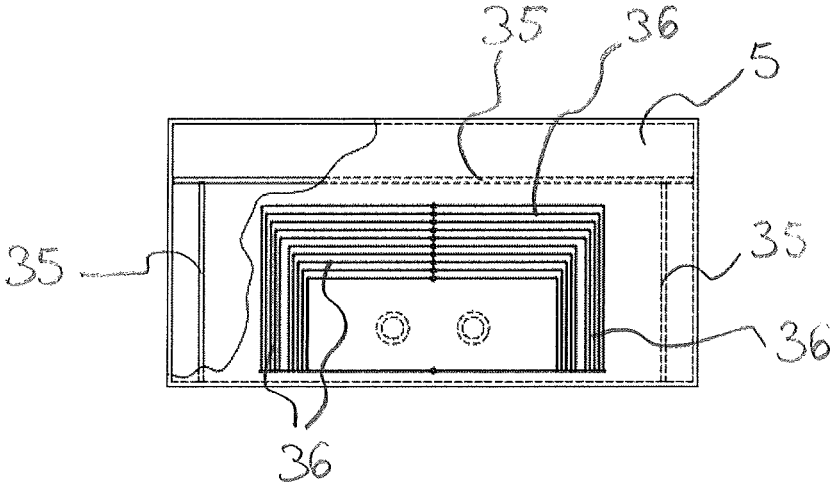
FIG. 14 shows a partially sectional top view of the portion of the support surface of FIG. 13.
Figure 15:
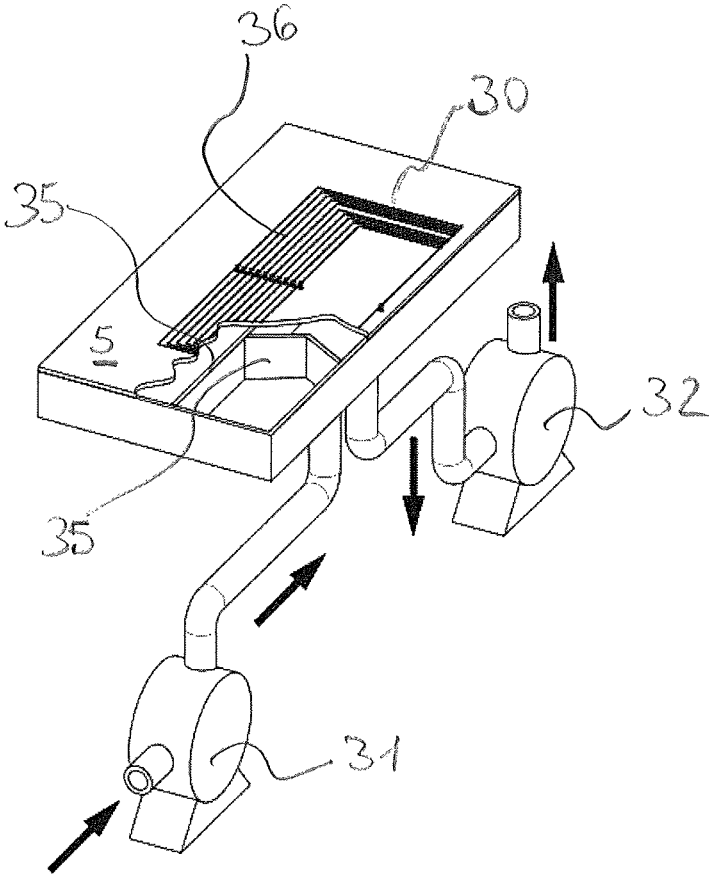
FIG. 15 shows the parts of FIG. 13 in a different operating configuration and FIG. 16 shows a partially sectional top view of the portion of the support surface of FIG. 15.
Figure 16:
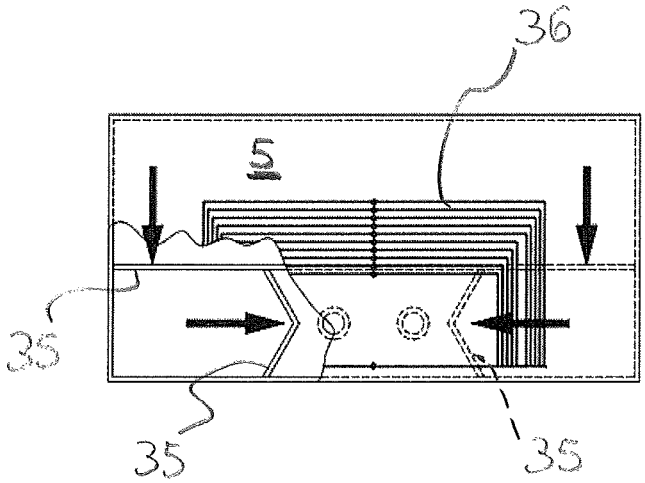

Preferably, the apparatus 1 comprises:

at least one movable wall 35 (in the example of FIGS. 13 to 16 three movable walls 35) for choking in a selectively adjustable manner the suction and/or blowing holes 30 of the support surface 5, which are in fluid communication with the aforementioned suction and/or blowing means 32, 31 (in the example of FIGS. 13 and 16 three movable walls 35 are provided) and fifth motor means (not shown) for adjustably moving the position of the aforementioned at least one movable wall 35 relative to the support surface 5 between a minimum choke operating position, in which all the suction and/or blowing holes 30 are in fluid communication with the aforementioned suction and/or blowing means 32, 31 and a maximum choke operating position, in which the suction and/or blowing holes 30 located outside said loading area of the support surface 5 are not in fluid communication with the aforementioned suction and/or blowing means 32, 31.

The aforementioned suction and/or blowing holes 30 of the support surface 5 allow the following actions to be exerted on the first photopolymer 6 placed on said support surface 5:

an effective suction when the holes are connected to said suction means 32, such that the photopolymer is entirely laid on the support surface 5 before detections are performed by the aforementioned detection means 8, to thereby reduce detection errors and an effective air blowing action from below against the bottom side of the first photopolymer 6 lying on the support surface 5, to afford low-friction displacement of the photopolymer 6 along the support surface 5 by the action of the aforementioned vacuum gripping manipulator 7.

According to a preferred embodiment (see FIGS. 13 to 16) in order to enhance the effectiveness of the aforementioned suction and blowing actions performed on the first photopolymer 6 through the suction and/or blowing holes 30 respectively, the top side of the support surface 5 comprises suction and/or blowing channels 36, which are open at their top and are in fluid communication with the aforementioned suction and/or blowing means 32, 31 through the aforementioned suction and/or blowing holes 30.

The aforementioned suction and/or blowing channels 36 can provide a more continuous and uniform suction or blowing action on the photopolymer 6 as compared with the action that would be obtained by the suction and/or blowing holes 30 only.

Advantageously, the apparatus 1 comprises first control means:

for controlling the actuation of the aforementioned first handling means 7 and for determining the displacement and rotation to be imparted to said photopolymer 6) to displace it from the loading area to the unloading area with a predetermined orientation and position, for proper application thereof to the first sleeve 3 rotatably supported in said workstation, according to the position and orientation of the photopolymer 6 as detected by the aforementioned first detection means 8*a*, 8*b*.

Preferably, the aforementioned first control means for controlling the actuation of the first handling means 7 comprise:

angular encoders with an accuracy of one thousandth of a degree for determining the instantaneous angular position of said first handling means 7 relative to an axis of rotation Z-Z perpendicular to the support surface 5 and linear encoders, preferably optical scales, with an accuracy of one micron for determining the instantaneous position of the first handling means 7 relative to the support surface 5.

Advantageously, the apparatus 1 comprises:

second support means 10 for rotatably supporting a coil 11 with a double-sided adhesive tape 12, first feeding and guiding means 13 for unwinding the double-sided adhesive tape 12 from said roll 11 and directing said unwound double-sided adhesive tape 12 to the surface of said first sleeve 3 rotatably supported in said workstation, to thereby cover the outer surface of said first sleeve 3 with said double-sided adhesive tape 12 and prepare said first sleeve 3 supported in the workstation to the application of photopolymers 6.

According to the illustrated embodiment, said support means 10 for rotatably supported a coil 11 with a double-sided adhesive tape 12 comprise a carriage 39 which is located below the support surface 5 and slides on guides 40 extending in the longitudinal direction. Such carriage 39 is equipped with a spindle 41 extending in the longitudinal direction X-X for rotatably supporting a respective coil 11 of double-sided adhesive tape.

According to the embodiment of FIG. 4 such carriage 39 carries a rotating carousel with two stations, each comprising a respective spindle 41 extending in the longitudinal direction X-X for rotatably supporting a respective coil 11 of double-sided adhesive tape.

The apparatus 1 further comprises:

second detection means 14 for detecting, on the outer surface of the first sleeve 3, a first axial section 15 of the surface that has already been covered by the double-sided adhesive tape 12 and for instantaneously detecting the position of the circumferential edge L of the head end of said first axial section 15 that has been already covered, a next contiguous axial section of double-sided adhesive tape 12 being designed to be juxtaposed thereto to cover a further section of said first sleeve 3;

second motor means for moving said double-sided adhesive tape 12 that is being fed on the surface of the first sleeve 3 in a first direction of displacement, having one component parallel to the axis of the sleeve 3 supported in said workstation, wherein a displacement of said double-sided adhesive tape 12 that is being fed to said first sleeve 3 in said first direction of displacement corresponds to an axial displacement of the point of application of said double-sided adhesive tape 12 on the surface of the first sleeve 3 supported in the workstation, and second feedback control means for determining and instantaneously feedback controlling the actuation of said second motor means according to the instantaneous position assumed by the circumferential edge L of the head end of said first axial section 15 that has been already covered, as instantaneously detected by said second detection means 14 to thereby determine, on the outer surface of the first sleeve 3, a circumferential point of application of a next contiguous axial section of double-sided adhesive tape 12 required to cover a further axial section of said first sleeve 3.

Advantageously, the above described feedback system allows a next axial section of the first sleeve 3 rotatably supported in said workstation to be covered with double-sided adhesive tape while ensuring instantaneous adaptation of the point of application of the adhesive tape on the outer surface of the sleeve 3 according to the detected displacement of the circumferential edge L of the head end of the axial section of the sleeve 3 that has been already covered. Such instantaneous feedback-controlled actuation can ensure that the outer surface of the sleeve 3 is covered with double-sided adhesive tape 12 in an error-free manner.

According to the preferred illustrated embodiment, the aforementioned second motor means control a displacement of the entire carriage 39 along the longitudinal guides 40, i.e. in the longitudinal direction X-X, such displacement of the carriage 39 causing a corresponding displacement of the coil 11 and the double-sided adhesive tape unwound therefrom in the longitudinal direction.

Preferably, the aforementioned second detection means 14 comprise a camera, a scanner, a laser detector or ultrasound sensors located in such positions as to detect, on the surface of said first sleeve 3 supported in said workstation, the circumferential edge L of the head end of said first axial section 15 that has already been covered, a next axial section of double-sided adhesive tape 12 unwound from said coil 11 being designed to be juxtaposed thereto.

According to the preferred embodiment (see FIGS. 9 to 12), the aforementioned second detection means 14 comprise a high-resolution digital camera.

The apparatus 1 comprises cutting means 19 for cutting the double-sided adhesive tape 11 unwound from the coil 11 in a direction perpendicular to the direction in which it is unwound from said coil 11.

Figure 9:
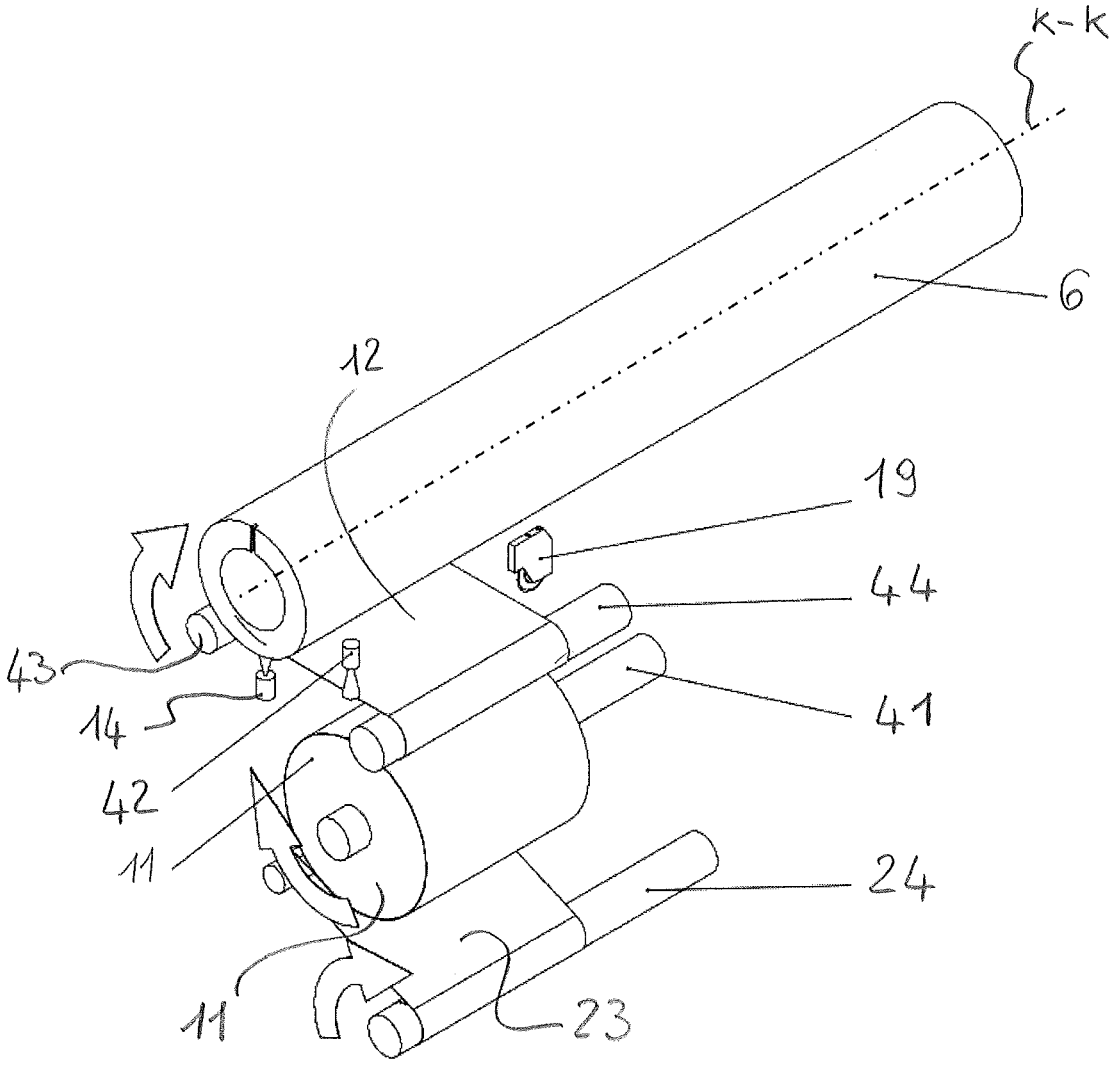
FIGS. 9 to 12 show simplified schematic views of the steps of application of a double-sided adhesive tape to a flexographic printing sleeve, with certain parts omitted.
Figure 10:
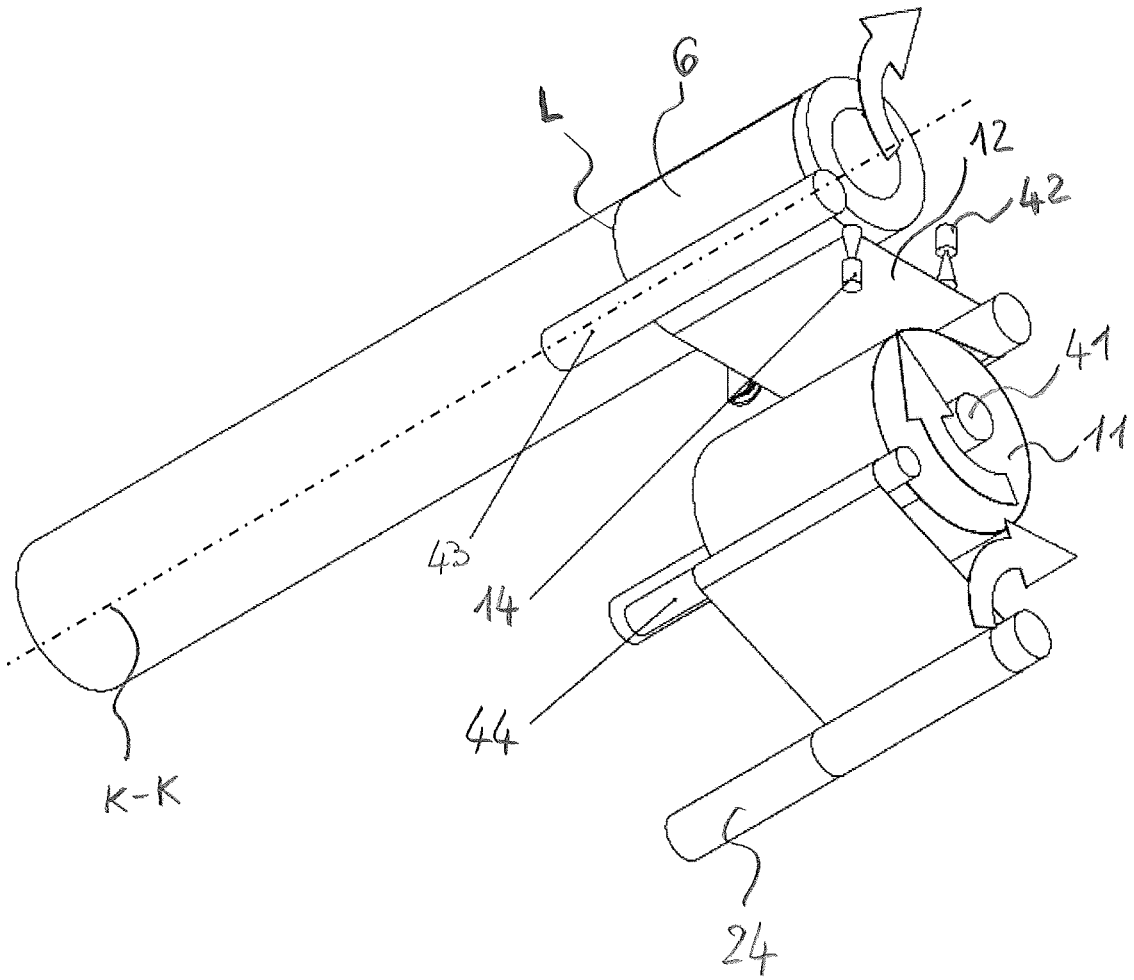
Figure 11:
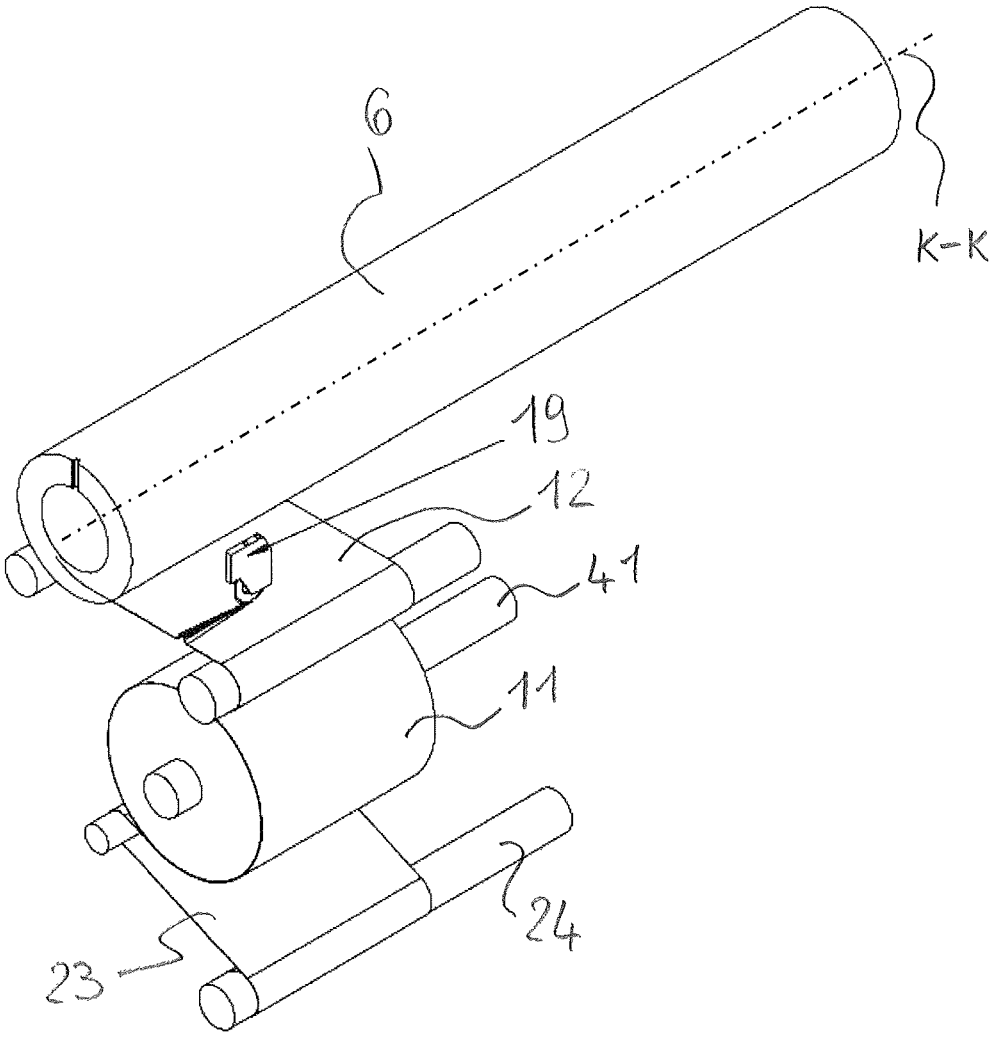
Figure 12:
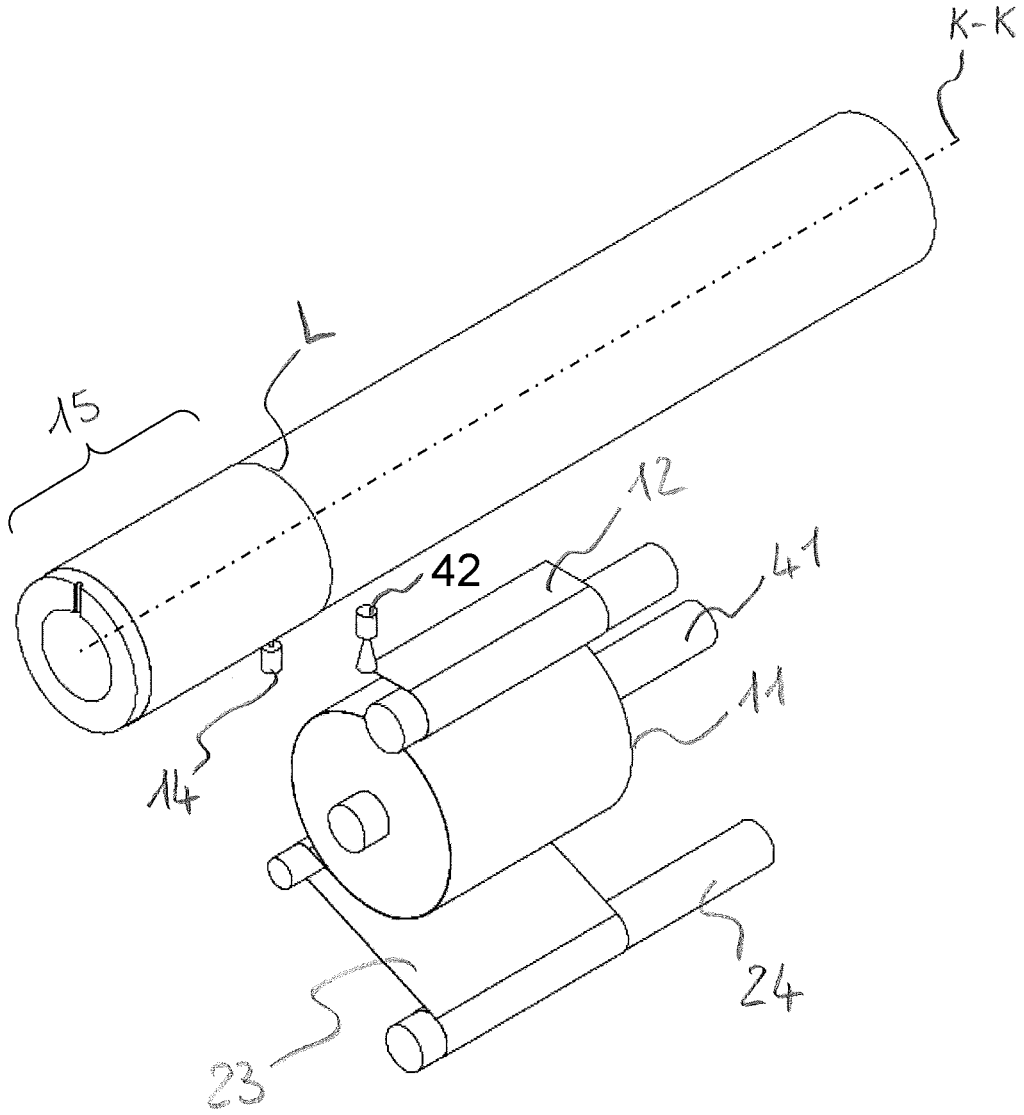

Preferably, the aforementioned cutting means 19 are located in such position as to act upon a section of the double-sided adhesive tape 12 interposed between the coil 11 and the aforementioned workstation (see FIGS. 9 and 11).

Preferably, the apparatus 1 further comprises:

means for measuring the length of the section of double-sided adhesive tape 12 unwound from said coil 11 and fed toward said first sleeve 3 supported in said workstation and third motor means for actuating said cutting means 19 as soon as the length that has been measured by said means for measuring a section of double-sided adhesive tape 12 unrolled from said coil 11 and fed toward the first sleeve 3 reaches a length value that equals the circumference of the outer surface of said first sleeve 3.

Preferably, the aforementioned third motor means comprise pneumatic actuation means.

Preferably, the double-sided adhesive tape 12 of the coil 11 comprises an anti-adhesive protective film 23 applied to one side of said double-sided adhesive tape 12 to prevent contact between overlapping turns of double-sided adhesive tape 12 in said coil 11.

In view of the above, the apparatus comprises means 44, 24 mounted in said carriage 39 for removing said anti-adhesive protective film 23 from said side of said double-sided adhesive tape 12:

during unwinding of said double-sided adhesive tape 12 from said coil 11, before said double-sided adhesive tape 12 contacts the surface of said first sleeve 3 supported in said workstation and before said cutting means 19, i.e. upstream from said cutting means, considering the direction of feed of said double-sided adhesive tape 12 from said coil 11 toward said first sleeve 3 supported in said workstation.

Preferably, the aforementioned means for removing said anti-adhesive protective film 23 comprise:

a peeling roller 44 which is placed in such position as to contact the anti-adhesive protective film 13 and cause it to be detached from the double-sided adhesive tape 12 unwound from the coil 11 and a motor-driven spindle 24, supported by said carriage 39 parallel to the spindle 41 of the coil 11 of double-sided adhesive tape 12, to rotatably drive a winding roller about which the anti-adhesive protective film 23 detached from the double-sided adhesive tape 12 is designed to be wound.

Preferably, the apparatus 1 comprises third detection means for checking, at said workstation, proper positioning of the photopolymers 6 applied to the surface of the sleeve 3 supported in said workstation.

Preferably, the task of the aforementioned third detection means is accomplished by said first detection means 8*a*, 8*b*, more preferably by one or both of the high-definition cameras of said pair of high-definition cameras 8*b*, appropriately moved to said workstation.

Preferably, the aforementioned first feeding and guiding means 13 for feeding and guiding the double-sided adhesive tape 12, comprise a plurality of driving rollers 26 for supporting and carrying said double-sided adhesive tape 12 until it is directed against said first sleeve 3 supported in said workstation.

The aforementioned driving rollers 26 define together a feeding guide for the double-sided adhesive tape 12, extending over a preset length between one inlet end and one outlet end of said feeding guide, considering the direction of feed of the double-sided adhesive tape 12 in the feeding guide, the outlet end of said feeding guide being positioned substantially against the outer surface of said first sleeve 3 supported in said workstation.

In view of the above, the double-sided adhesive tape 3 will contact a portion of the cylindrical sidewall of said first sleeve 3 and adhere thereto, the rotation of said first cylindrical sleeve 3 about its axis of rotation also driving the rotation of the rest of the section of the double-sided adhesive tape 3 and causing it to adhere to the outer side of the cylindrical sleeve.

Figure 5:
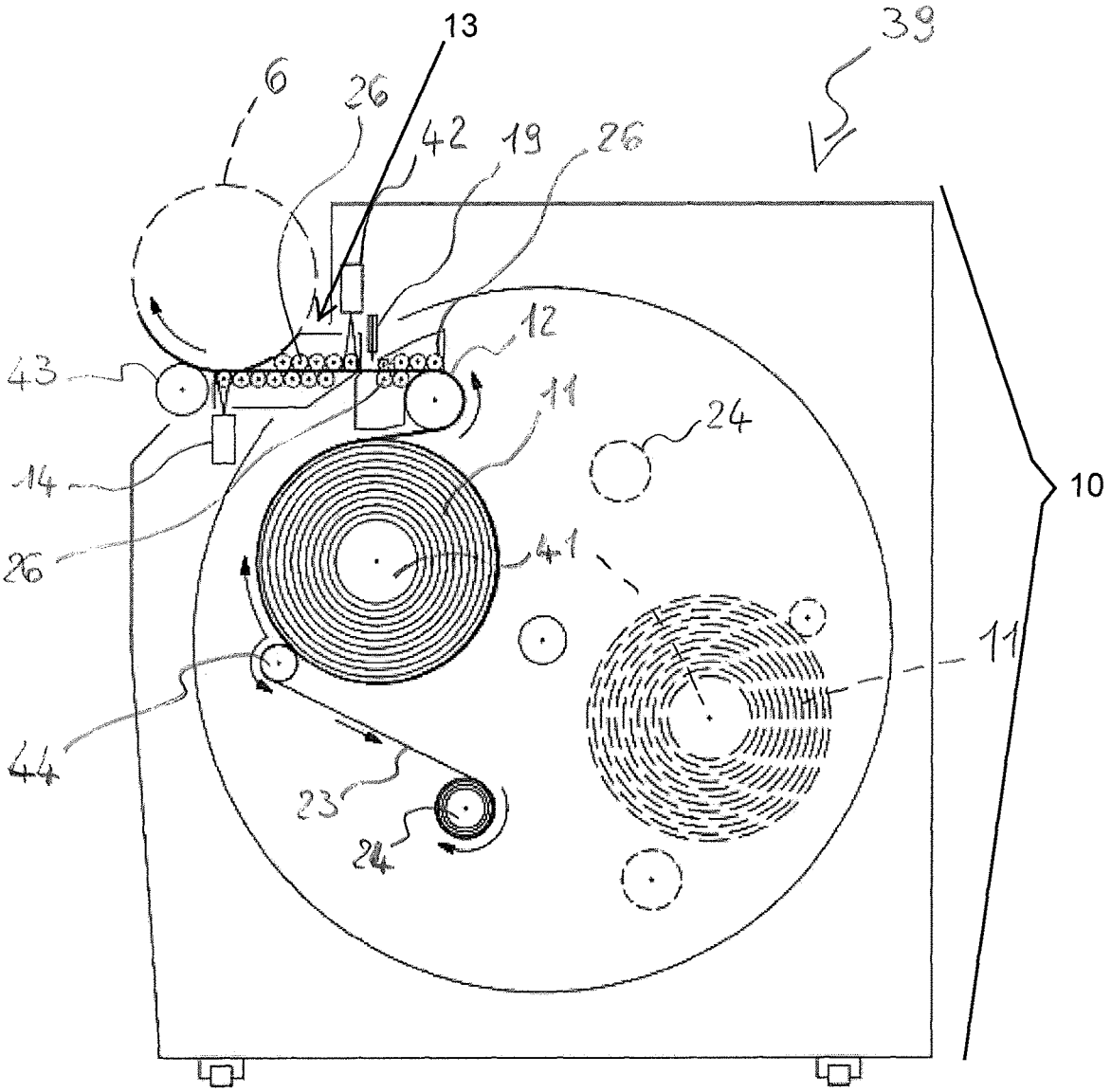
FIG. 5 shows a cross-sectional view of a detail of the machine of FIG. 1, particularly the area in which the double-sided adhesive tape is fed to the flexographic printing sleeve.

As shown in FIG. 5, the double-sided adhesive tape 12 is driven forward between opposed upper and lower rollers, and is accurately guided thereby.

In order to prevent the double-sided adhesive tape from sticking with the driving rollers 26, the surface of the latter is formed with non-stick features relative to the double-sided adhesive tape 12. This is obtained, for instance, by using metal rollers with a plasma-treated surface or forming the rollers with non-stick polymeric materials.

Preferably, the apparatus 1 is also equipped with fourth detection means 42, e.g. a camera, located proximate to said driving rollers 26 to detect the presence of a section of double-sided adhesive tape 12 unwound from said coil 11 and selectively fed and guided to the surface of said first sleeve 3 before said double-sided adhesive tape contacts said first sleeve 3.

Preferably, the aforementioned cutting means 19 for cutting said double-sided adhesive tape 12 are located proximate to said driving rollers 26, more preferably at a position interposed between said inlet end and said outlet end of said feeding guide.

Figure 6:
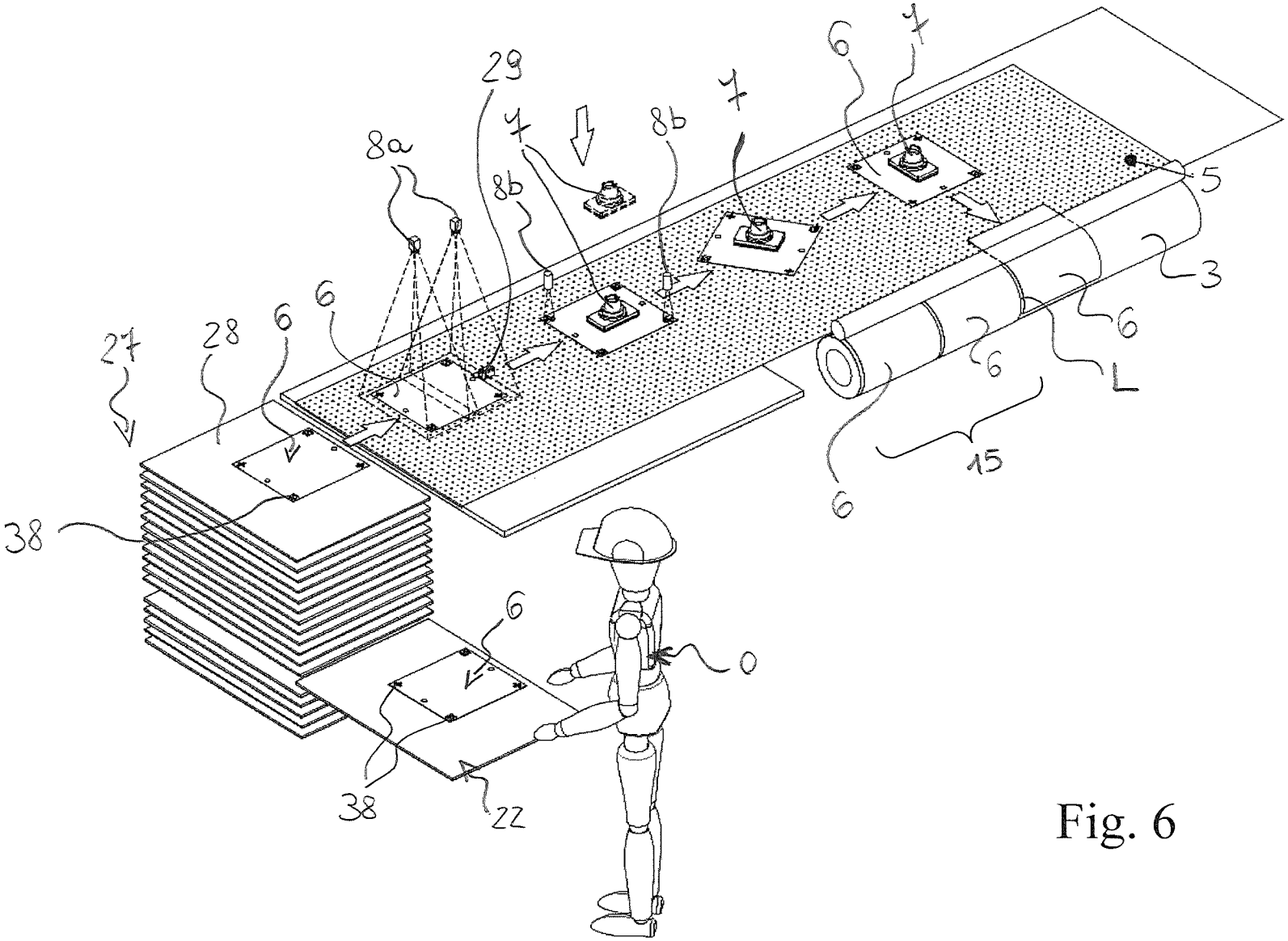
FIG. 6 shows a schematic overview of the various steps of application of the photopolymers to a flexographic printing sleeve using the machine of FIG. 1.

FIG. 6 is a simplified schematic view showing an exemplary displacement arrangement of the photopolymers in the apparatus 1:

as a photopolymer 6 is placed into a tray 28 of the tray unit 27 by an operator O, as a photopolymer 6 is placed onto the support surface 5 by the gripper 29, for detection by the first low-definition detection means 8*a*, as the photopolymer 6 is engaged by the handling means 7 and is displaced, for detection by the first high-definition detection means 8*b*;

as the photopolymer 6 is fed on the support surface 5 by the handling means 7, and is placed in the unloading area of the support surface and as the photopolymer 6 is applied to a flexographic printing sleeve 3 rotatably supported in the workstation.

It shall be noted in this respect that the apparatus 1 moves one photopolymer 6 at a time on the support surface 5, and that FIG. 6 shall be intended to exemplarily show what happens in a single working cycle in which a photopolymer 6 is applied to the flexographic printing sleeve.

Preferably, the apparatus 1 also comprises a brushing roller 43, extending in the longitudinal direction X-X to be in facing and substantially juxtaposed relationship to the sleeve 3 rotatably supported in the workstation. Said brushing roller 43 is placed more downstream from the cylindrical sidewall of said first sleeve 3 than said first feeding and guiding means 13 for feeding and guiding the double-sided adhesive tape, considering the direction of rotation of said first sleeve 3 rotatably supported in said workstation (see FIG. 5).

According to the present invention, the process of preparing a flexographic printing sleeve 3 using an apparatus, comprising the steps of:

providing a first flexographic printing sleeve 3 having a preset axis K-K;

providing strips of double-sided adhesive tape 12 whose axial length is substantially equal to the outer circumference of said sleeve 3;

rotating said first sleeve 3 supported in said workstation about its axis and by means of first feeding and guiding means 13, selectively feeding and guiding said strips of double-sided adhesive tape 12 to the surface of said first sleeve 3 for circumferential application of said strips of double-sided adhesive tape 12 to the outer surface of said first sleeve 3, such that:

each strip of double-sided adhesive tape 12 defines a cover ring, which is coaxial with the axis of said first sleeve 3 and is as wide as said double-sided adhesive tape 12 and at least one preset axial section of said first sleeve 3 supported in said workstation is covered with a succession of said cover rings of double-sided adhesive tape 12, arranged in juxtaposed relationship along the axis of said sleeve 3.

Preferably, the above described process includes the steps of:

detecting, by second detection means 14, on the outer surface of said first sleeve 3, a first axial section 15 of the surface that has already been covered with said strips of double-sided adhesive tape and instantaneously detecting the position of the circumferential edge L of the head end of said first axial section 15 that has been already covered, a next contiguous axial strip of double-sided adhesive tape 12 being designed to be juxtaposed thereto to cover a further section of said first sleeve 3;

during application of said next contiguous strip of double-sided adhesive tape 12, moving said next contiguous strip of double-sided adhesive tape 12 to be applied, by second motor means, in a first direction of displacement X-X having one component parallel to the axis of said sleeve (3) rotatably supported in said workstation, and by means of second feedback control means, determining and instantaneously controlling the feedback of the actuation of said second motor means according to the position of the circumferential edge L of the head end of said first axial section 15 that has been already covered, as instantaneously detected by said second detection means 14 to thereby determine the application of said next contiguous strip of double-sided adhesive tape 12 on the outer surface of said first sleeve 3, in a circumferential point that is next and contiguous to the circumferential edge L of the head end of said first axial section 15 that has been already covered.

Preferably, the aforementioned strips of double-sided adhesive tape 12 whose axial length is substantially equal to the outer circumference of said sleeve 3 are formed by:

unwinding the double-sided adhesive tape 12 of a coil 11 of double-sided adhesive tape 12, which is rotatably supported by said apparatus 1 and transversely cutting the double-sided adhesive tape 12 unwound from said coil and selectively fed and guided to the surface of said first sleeve 3, using cutting means 19 of said apparatus.

Preferably, the aforementioned process comprises the step of detecting the presence of a section of double-sided adhesive tape 12 unwound from said coil 11 and selectively fed and guided to the surface of said first sleeve 3 before said double-sided adhesive tape contacts said first sleeve 3, to increase the accuracy of detection of the tape section being carried.

Preferably:

said double-sided adhesive tape 12 comprises an anti-adhesive protective film 23 applied to one side of said double-sided adhesive tape 12 to prevent contact between overlapping turns of double-sided adhesive tape 12 in said coil 11, said apparatus 1 comprises means 44, 24 for removing said anti-adhesive protective film 23 from the side of said double-sided adhesive tape 12, and the process of the invention comprises the step of removing said anti-adhesive protective film 23 from said side of said double-sided adhesive tape 12:

during unwinding of said double-sided adhesive tape 12 from said coil 11, before said cutting means 19, i.e. upstream from said cutting means, considering the direction of feed of said double-sided adhesive tape 12 from said coil 11 toward said first sleeve 3 supported in said workstation.

Preferably, the process of the invention comprises a step of rolling the aforementioned anti-adhesive protective film 23 removed from said side of said double-sided adhesive tape 12) around a winding roller.

Preferably, the process also comprises the steps of:

providing an apparatus 1 with a support structure 21 comprising:

first support means 2 which define a workstation for rotatably supporting said first sleeve 3 such that it can rotate about its preset axis K-K, first motor means 4 associated with said first support means 2, for rotating said first sleeve 3 supported in said workstation, about its axis;

a support surface 5 having a top side upon which a first photopolymer 6 to be applied to said sleeve 3 supported in said workstation is designed to be positioned, said support surface having, defined therein:

a loading area whereat said first photopolymer 6 is initially positioned for detection and an unloading area wherefrom said first photopolymer 6 is directed toward said first sleeve 3 supported in said workstation, said unloading area being distal from said loading area;

first handling means 7 for moving and orienting said first photopolymer 6 on said support surface 5 from said loading area to said unloading area and first detection means 8*a*, 8*b* for detecting the presence of a photopolymer 6 at said loading area of said support surface 5 and for detecting the position and orientation of said photopolymer 6 on said support surface 5 and directing the first photopolymer 6 from the unloading area of the support surface 5 to the outer surface of the first sleeve 3 supported in the workstation.

Preferably, said step of selectively feeding and guiding said strips of double-sided adhesive tape 12 to the surface of said first sleeve 3 using first feeding and guiding means 13 is only carried out when said first sleeve 3 has a longitudinal section of its cylindrical sidewall free of double-sided adhesive tape 12, which will prevent a section of double-sided adhesive tape 12 fed toward said first sleeve 3 from interfering with another section of double-sided adhesive tape 12 already adhered to said first sleeve 3.

Preferably, the process also comprises the steps of:

positioning a first photopolymer 6 in said loading area of the support surface 5;

detecting the position and orientation of said first photopolymer 6 on said support surface 5 in said loading area, using said first detection means 8*a*, 8*b;* according to the detected position and orientation of said first photopolymer 6 on said support surface 5 in said loading area, calculating the translational and rotational components to be imparted to said first photopolymer 6 by said first handling means 7 to displace said first photopolymer 6 from said loading area to said unloading area with predetermined orientation and position for proper application thereof to said first sleeve 3;

by means of first control means, controlling the actuation of said first handling means 7 and displacing said first photopolymer 6 from said inlet area to said unloading area of said support surface according to the translational and rotational components so calculated, without requiring any check or verification of the position of the photopolymer in said unloading area of said support surface before directing it to said first sleeve 3 and during application to said first sleeve.

Preferably, the first control means for controlling the actuation of said first handling means 7 comprise:

angular encoders with an accuracy of one thousandth of a degree for determining the instantaneous angular position of said first handling means 7 relative to an axis of rotation Z-Z perpendicular to the support surface 5 and linear encoders, preferably optical scales, with an accuracy of one micron for determining the instantaneous position of said first handling means 7 relative to said support surface 5, said step of controlling the actuation of the first handling means 7 and displacing said first photopolymer 6 from said inlet area to said unloading area of said support surface 5 according to the translational and rotational components so calculated is carried out by controlling:

with an accuracy of one thousandth of a degree the instantaneous angular position assumed by the first handling means 7 relative to the axis of rotation Z-Z perpendicular to the support surface 5 and with an accuracy of one micron the instantaneous position assumed by the first handling means 7 relative to the support surface 5.

Preferably, the aforementioned first handling means 7 for displacing said photopolymer 6 contact said first photopolymer 6 laying flat on said support surface from above and exert a suction action on said first photopolymer 6 to be jointly displaced with said first photopolymer during displacement on the support surface 5, without requiring the photopolymer to be pressed against the support surface 5.

Preferably:

said apparatus comprises suction means 32 and said support surface 5 comprises suction holes 30 formed in said support surface 5, open at the top side of the support surface 5 and in fluid communication with said suction means 32 and said step of detecting the position and orientation of said first photopolymer 6 on said support surface 5 in said loading area, by a detection performed by said first detection means 8*a*, 8*b* is preceded by a step of laying said first photopolymer 6 on the top side of said support surface 5, by means of suction.

Preferably:

said apparatus comprises blowing means 31 and said support surface 5 comprises blowing holes 30 formed in said support surface 5, open at the top side of the support surface 5 and in fluid communication with said blowing means 31 and said step of displacing said first photopolymer 6 on said support surface 5 from said inlet area to said unloading area is carried out during a step in which air is blown from said blowing holes 30 of the support surface, to substantially eliminate the force that presses said first photopolymer 6 on the top side of said support surface 5.

Preferably, said step of detecting the position and orientation of said first photopolymer 6 on said support surface 5 is carried out by:

a first step of detecting the edge of said first photopolymer 6 located in said inlet area of the support surface 5 and a later step of detecting and reading one or more positioning and centering marks 38 on said first photopolymer 6.

Preferably, before removal of said first sleeve 3 from said workstation, the process of the invention comprises the step of:

detecting the position of said one or more photopolymers 6 on the outer surface of said first sleeve 3 using third detection means, preferably embodied by one or both of the high-definition cameras of said pair of high-definition cameras 8*b* of the first detection means, appropriately moved to said workstation, and checking whether the position of said one or more photopolymers 6 applied to the outer surface of said first sleeve 3 falls within the positioning range that has been set for each photopolymer 6, to determine whether said first sleeve 3 is suitable for a later flexographic printing step.

If no adhesive tape has to be applied to the flexographic printing sleeve 3, e.g. because the flexographic printing sleeve 3 is already equipped with adhesive, then the process for application of photopolymers 6 to a sleeve using an apparatus comprises the steps of:

providing a first flexographic printing sleeve 3 having a preset axis K-K;

providing an apparatus 1 with a support structure 21 comprising:

first support means 2 which define a workstation for rotatably supporting said first sleeve 3 such that it can rotate about its preset axis K-K;

first motor means 4 associated with said first support means 2, for rotating said first sleeve 3 supported in said workstation, about its axis;

a support surface 5 having a top side upon which a first photopolymer 6 to be applied to said sleeve 3 supported in said workstation is designed to be positioned, said support surface having, defined therein:

a loading area whereat said first photopolymer 6 is initially positioned for detection and an unloading area wherefrom said first photopolymer 6 is directed toward said first sleeve 3 supported in said workstation, said unloading area being distal from said loading area;

first handling means 7 for moving and orienting said first photopolymer 6 on said support surface 5 from said loading area to said unloading area and first detection means 8*a*, 8*b* for detecting the presence of a photopolymer 6 at said loading area of said support surface 5 and for detecting the position and orientation of said photopolymer 6 on said support surface 5;

rotating said first sleeve 3 supported in said workstation about its axis and applying said one or more photopolymers 6 to the outer surface of said first sleeve 3 supported in said workstation 12, said steps being preferably supplemented by the above discussed preferred steps.

As clearly shown in the above description, the apparatus for preparing a flexigraphic printing sleeve of the invention can fulfill the aforementioned needs and also obviate prior art drawbacks as set out in the introduction of this disclosure.

The application of the double-sided adhesive tape to the outer surface of the flexographic printing sleeve, and possibly also later application of the photopolymers to the outer surface of the flexographic printing sleeve so covered are automatically performed by the apparatus and the process of the invention, in a single working cycle, while ensuring the positioning accuracy required for flawless flexographic printing.

Another advantage of the apparatus and process of the invention is the possibility of applying various successive sections of a double-sided adhesive tape in perfectly juxtaposed relationship along the axis of the sleeve.

A further advantage of the apparatus and process of the invention is the possibility of a very quick and accurate application of the photopolymers to flexographic printing sleeves, without requiring any supervision by an operator, and possibly using flexographic printing sleeves whose exterior surface has not been covered with a double-sided adhesive tape yet.

Another advantage of the apparatus and process of the invention is the possibility of quickly and accurately moving the photopolymers along the support surface of the machine without inducing deformations in the structure of the photopolymers, such that they may be accurately positioned and directed to the flexographic printing sleeve according to displacement (translational and rotational) values that have been calculated beforehand based on the initial detected position of each photopolymer on the support surface, and hence without having to detect, using a camera or the like, the proper position achieved by each photopolymer in the loading area of the support surface, before application to the flexographic printing sleeve.

A further advantage of the apparatus and process of the invention is the possibility of a very quick and accurate application of the photopolymers to flexographic printing sleeves, without requiring any supervision by an operator, even using flexographic printing sleeves whose exterior surface has not been covered with a double-sided adhesive tape yet.

Those skilled in the art will obviously appreciate that a number of changes and variants may be made to the apparatus and process of the invention to meet specific needs, without departure from the scope of the invention, as defined in the following claims.

Particularly if the apparatus for preparing a flexographic printing sleeve only applies the double-sided adhesive tape to the flexographic printing sleeve, and doesn't place the photopolymers to the flexographic sleeve, such apparatus may be greatly simplified as compared to the above description. For example, the apparatus may not feature a support surface, photopolymer handling means and photopolymer detection means, as these will not be needed for application of the double-sided adhesive tape to the flexographic printing sleeve.

Likewise, if the application of the double-sided adhesive tape to the flexographic printing sleeve is not required, the machine of the invention may only include the above described means for ensuring accurate positioning of the photopolymers to the flexographic sleeve, the aforementioned means for applying the double-sided adhesive tape to the flexographic printing sleeve being no longer needed.

The invention claimed is:

1. An apparatus for preparing a flexographic printing sleeve, comprising a support structure which comprises:

first support means, which defines a workstation for rotatably supporting a first flexographic printing sleeve having a preset axis, for said first sleeve to rotate about its axis, relative to said support structure;

first motor means associated with said first support means, for rotating said first sleeve supported in said workstation, about its axis;

wherein:

second support means for rotatably supporting a coil with a double-sided adhesive tape, first feeding and guiding means for unwinding the double-sided adhesive tape from said roll and directing said double-sided adhesive tape to the surface of said first sleeve supported in said workstation, to thereby cover the outer surface of said first sleeve with said double-sided adhesive tape and prepare said first sleeve supported in said workstation to the application of photopolymers, second detection means for detecting, on the outer surface of said first sleeve, a first axial section of the surface that has already been covered by said double-sided adhesive tape and for instantaneously detecting a position of a circumferential edge of the head end of said first axial section that has been already covered, and a next contiguous axial section of double-sided adhesive tape being designed to be juxtaposed to said circumferential edge to cover a further section of said first sleeve;

second motor means for moving said double-sided adhesive tape that is being fed on the surface of said first sleeve in a first direction of displacement, having one component parallel to the axis of said sleeve supported in said workstation, and a displacement of said double-sided adhesive tape that is being fed to said first sleeve in said first direction of displacement corresponds to an axial displacement of the point of application of said double-sided adhesive tape on the surface of said first sleeve supported in said workstation, and second feedback control means for determining and instantaneously controlling feedback of actuation of said second motor means according to the instantaneous position assumed by the circumferential edge of the head end of said first axial section that has been already covered, as instantaneously detected by said second detection means to thereby determine, on the outer surface of said first sleeve, a circumferential point of application of a next contiguous axial section of double-sided adhesive tape required to cover a further axial section of said first sleeve.

2. The apparatus according to claim 1, wherein said second detection means comprise at least one of a camera, a scanner, a laser detector or ultrasound sensors located in such positions as to detect, on the surface of said first sleeve supported in said workstation, the circumferential edge of the head end of said first axial section that has already been covered, a next axial section of double-sided adhesive tape unwound from said roll being designed to be juxtaposed thereto.

3. The apparatus according to claim 1, comprising cutting means for cutting said double-sided adhesive tape unwound from said roll in a direction transverse to the direction of unwinding thereof from the coil, wherein:

said cutting means is located in such position as to act upon a section of said double-sided adhesive tape interposed between said roll and said workstation.

4. The apparatus according to claim 3, comprising:

means for measuring a length of the section of double-sided adhesive tape unwound from said roll and fed toward said first sleeve supported in said workstation;

third motor means for actuating said cutting means as soon as the length that has been measured by said means for measuring a section of double-sided adhesive tape unrolled from said roll and fed toward said first sleeve reaches a length value that equals the circumference of the outer surface of said first sleeve.

5. The apparatus according to claim 1, comprising:

a photopolymer-holder for receiving one or more separate photopolymers in a lying position; and pick-up means for selectively picking up said one or more photopolymers from said photopolymer-holder and carrying the photopolymer that has picked up into said loading area of said support surface.

6. An apparatus for preparing a flexographic printing sleeve comprising a support structure which comprises:

first support means, which defines a workstation for rotatably supporting a first flexographic printing sleeve having a preset axis, for said first sleeve to rotate about its axis, relative to said support structure;

first motor means associated with said first support means, for rotating said first sleeve supported in said workstation about its axis;

second support means for rotatably supporting a coil with a double-sided adhesive tape, first feeding and guiding means for unwinding the double-sided adhesive tape from said roll and directing said double-sided adhesive tape to the surface of said first sleeve supported in said workstation, to thereby cover the outer surface of said first sleeve with said double-sided adhesive tape and prepare said first sleeve supported in said workstation for the application of photopolymers, further comprising cutting means for cutting said double-sided adhesive tape unwound from said roll in a direction transverse to the direction of unwinding thereof from the coil, wherein:

said cutting means is located in such position as to act upon a section of said double-sided adhesive tape interposed between said roll and said workstation, said double-sided adhesive tape comprises an anti-adhesive protective film applied to one side of said double-sided adhesive tape to prevent contact between overlapping turns of double-sided adhesive tape in said roll, and said apparatus comprises means for removing said anti-adhesive protective film from said side of said double-sided adhesive tape as said double-sided adhesive tape is being unwound from said roll, before said double-sided adhesive tape contacts the surface of said first sleeve supported in said workstation and upstream from said cutting means, considering the direction of feed of said double-sided adhesive tape from said coil toward said first sleeve.

7. An apparatus for preparing a flexographic printing sleeve comprising a support structure which comprises:

first support means, which defines a workstation for rotatably supporting a first flexographic printing sleeve having a preset axis, for said first sleeve to rotate about its axis, relative to said support structure;

first motor means associated with said first support means, for rotating said first sleeve supported in said workstation about its axis;

second support means for rotatably supporting a coil with a double-sided adhesive tape, first feeding and guiding means for unwinding the double-sided adhesive tape from said roll and directing said double-sided adhesive tape to the surface of said first sleeve supported in said workstation, to thereby cover the outer surface of said first sleeve with said double-sided adhesive tape and prepare said first sleeve supported in said workstation for the application of photopolymers, further comprising cutting means for cutting said double-sided adhesive tape unwound from said roll in a direction transverse to the direction of unwinding thereof from the coil, wherein:

said cutting means is located in such position as to act upon a section of said double-sided adhesive tape interposed between said roll and said workstation, a support surface having a top side upon which a first photopolymer to be applied to said sleeve supported in said workstation is designed to be positioned, wherein:

said support surface comprises a loading area whereat said first photopolymer to be applied to said first sleeve supported in said workstation is initially positioned for detection, and said support surface comprises an unloading area wherefrom said first photopolymer is directed toward said first sleeve supported in said workstation, and said unloading area being distal from said loading area;

first handling means for moving and orienting said first photopolymer on said support surface from said loading area to said unloading area;

first detection means for detecting the presence of a photopolymer at said loading area of said support surface and for detecting the position and orientation of said photopolymer on said support surface, and first control means for controlling actuation of said first handling means and, according to the position and orientation of the photopolymer as detected by said first detection means, for determining the displacement and rotation to be imparted to said photopolymer to displace said photopolymer from said loading area to said unloading area with a predetermined orientation and position, for proper application thereof to the first sleeve rotatably supported in said workstation.

8. The apparatus according to claim 7, wherein said first control means for controlling the actuation of said first handling means comprise:

angular encoders with an accuracy of one thousandth of a degree for determining an instantaneous angular position of said first handling means relative to an axis of rotation perpendicular to said support surface, and linear encoders with an accuracy of one micron for determining an instantaneous position of said first handling means relative to said support surface.

9. The apparatus according to claim 7, wherein said first detection means comprise at least one of a camera, a scanner, a laser detector or optical sensors located in such positions above said support surface as to capture an image of said photopolymer, and said first detection means comprise;

a pair of first low-definition detection means, for detecting the edges of said first photopolymer positioned in said loading area of said support surface, and a pair of first high-definition detection means, for detecting and reading, inside the edges of said first photopolymer that has been detected, one or more positioning and centering marks provided on said first photopolymer.

10. The apparatus according to claim 7, wherein:

said first handling means comprise a vacuum gripping manipulator supported by said support structure above said support surface;

with respect to said support surface, said vacuum gripping manipulator is:

vertically movable toward/away from said support surface;

translationally movable parallel to said support surface;

rotatably movable about an axis of rotation perpendicular to said support surface, and said apparatus comprises fourth motor means for actuating said vacuum gripping manipulator relative to said support surface, toward and away from said support surface, for translational movement relative to said support surface and for rotation about said axis of rotation perpendicular to said support surface, said vacuum gripping manipulator eventually adhering from above to the surface of said first photopolymer positioned in said loading area of said support surface for exerting a suction action on said first photopolymer and thereby becoming jointly displaceable therewith as said vacuum gripping manipulator moves on the support surface to said unloading area of said support surface in the proper position and orientation for application to the sleeve supported in said workstation.

11. The apparatus according to claim 10, wherein:

said vacuum gripping manipulator comprises a bottom side facing the top side of said support surface, said bottom side of said vacuum gripping manipulator being designed to contact and adhere to said first photopolymer, supported on said support surface, to cause displacement and rotation thereof from said loading area to said unloading area of said support surface, and said bottom side of said gripping means has a plurality of suction openings connected to suction means.

12. The apparatus according to claim 11, wherein:

said bottom side of said vacuum gripping manipulator comprises a middle area, having a surface area of at least 10 $cm^2$ at which said plurality of suction openings are evenly distributed, and a peripheral edge defining a sealing frame, and said middle area of the vacuum gripping manipulator is a flat surface designed to adhere completely to the surface of said first photopolymer to be displaced, to prevent any local and point-like action on a limited portion of said first photopolymer.

13. The apparatus according to claim 7, comprising:

suction and/or blowing means, and suction and/or blowing holes formed in said support surface and in fluid communication with said suction and/or blowing means, for suction of air from the top side of said support surface or for discharge of blown air out of the top side of said support surface.

14. The apparatus according to claim 13, wherein:

said suction and/or blowing means are connected in fluid communication with an air manifold which is sealingly mounted underneath said support surface to be in fluid communication with the suction and/or blowing holes of said support surface, or said support surface comprises an inner cavity, said inner cavity being in fluid communication with said suction and/or blowing means and being delimited at its top by a wall of said support surface comprising said suction and/or blowing holes.

15. The apparatus according to claim 13, comprising:

at least one movable wall for choking, in a selectively adjustable manner, the suction and/or blowing holes of said support surface in fluid communication with said suction and/or blowing means, and fifth motor means for adjustably moving the position of said at least one movable wall relative to said support surface between a minimum choke operating position, in which all the suction and/or blowing holes are in fluid communication with said suction and/or blowing means, and a maximum choke operating position, in which the suction and/or blowing holes located outside said loading area of the support surface are not in fluid communication with said suction and/or blowing means.

16. The apparatus according to claim 13, wherein:

the top side of said support surface comprises suction and/or blowing channels that are open at a top thereof; and said suction and/or blowing channels are in fluid communication with said suction and/or blowing means through said suction and/or blowing holes.

17. The apparatus according to claim 7, comprising third detection means for checking, at said workstation, proper positioning of the photopolymers applied to the surface of the sleeve supported in said workstation.

18. The apparatus according to claim 7, comprising fourth detection means located proximate to driving rollers to detect a presence of a section of double-sided adhesive tape unwound from said roll and selectively fed and guided to the surface of said first sleeve before said double-sided adhesive tape contacts said first sleeve.

19. An apparatus for preparing a flexographic printing sleeve comprising a support structure which comprises:

first support means, which defines a workstation for rotatably supporting a first flexographic printing sleeve having a preset axis, for said first sleeve to rotate about its axis, relative to said support structure;

first motor means associated with said first support means, for rotating said first sleeve supported in said workstation about its axis;

second support means for rotatably supporting a coil with a double-sided adhesive tape, first feeding and guiding means for unwinding the double-sided adhesive tape from said roll and directing said double-sided adhesive tape to the surface of said first sleeve supported in said workstation, to thereby cover the outer surface of said first sleeve with said double-sided adhesive tape and prepare said first sleeve supported in said workstation for the application of photopolymers, said first feeding and guiding means comprise a plurality of driving rollers for supporting and carrying said double-sided adhesive tape until said double-sided adhesive tape is directed against said first sleeve supported in said workstation, and driving rollers define a feeding guide for said double-sided adhesive tape, extending over a preset length between one inlet end and one outlet end of said guide, considering the direction of feed of the double-sided adhesive tape in said feeding guide.

20. An apparatus for preparing a flexographic printing sleeve comprising a support structure which comprises:

first support means, which defines a workstation for rotatably supporting a first flexographic printing sleeve having a preset axis, for said first sleeve to rotate about its axis, relative to said support structure;

first motor means associated with said first support means, for rotating said first sleeve supported in said workstation about its axis;

second support means for rotatably supporting a coil with a double-sided adhesive tape, first feeding and guiding means for unwinding the double-sided adhesive tape from said roll and directing said double-sided adhesive tape to the surface of said first sleeve supported in said workstation, to thereby cover the outer surface of said first sleeve with said double-sided adhesive tape and prepare said first sleeve supported in said workstation for the application of photopolymers, further comprising cutting means for cutting said double-sided adhesive tape unwound from said roll in a direction transverse to the direction of unwinding thereof from the coil, wherein:

said cutting means is located in such position as to act upon a section of said double-sided adhesive tape interposed between said roll and said workstation, and said cutting means for cutting said double-sided adhesive tape is located proximate to driving rollers.

21. A process of preparing a flexographic printing sleeve using an apparatus, the process comprising:

A) providing a first flexographic printing sleeve having a preset axis;

B) providing strips of double-sided adhesive tape whose axial length is substantially equal to an outer circumference of said sleeve;

C) providing an apparatus with a support structure comprising:

first support means, which defines a workstation for rotatably supporting said first sleeve such that said first sleeve can rotate about its preset axis;

first motor means associated with said first support means, for rotating said first sleeve supported in said workstation, about its axis;

D) rotating said first sleeve supported in said workstation about its axis, and

E) by means of first feeding and guiding means, selectively feeding and guiding said strips of double-sided adhesive tape to the surface of said first sleeve for circumferential application of said strips of double-sided adhesive tape to the outer surface of said first sleeve, such that:

each strip of double-sided adhesive tape defines a cover ring, said cover ring being coaxial with the axis of said first sleeve and being as wide as said double-sided adhesive tape, and at least one preset axial section of said first sleeve supported in said workstation is covered with one of said cover rings of double-sided adhesive tape or a succession of said cover rings of double-sided adhesive tape, arranged in juxtaposed relationship along the axis of said sleeve, detecting, by second detection means, on the outer surface of said first sleeve, a first axial section of the surface that has already been covered with said strips of double-sided adhesive tape and instantaneously detecting the position of the circumferential edge of the head end of said first axial section that has been already covered, a next contiguous axial strip of double-sided adhesive tape being designed to be juxtaposed thereto to cover a further section of said first sleeve;

during application of said next contiguous strip of double-sided adhesive tape, moving said next contiguous strip of double-sided adhesive tape to be applied, by second motor means, in a first direction of displacement having one component parallel to the axis of said sleeve rotatably supported in said workstation, and by second feedback control means, determining and instantaneously controlling feedback of actuation of said second motor means according to the position of the circumferential edge of the head end of said first axial section that has been already covered, as instantaneously detected by said second detection means to thereby determine the application of said next contiguous strip of double-sided adhesive tape on the outer surface of said first sleeve, in a circumferential point that is next and contiguous to the circumferential edge of the head end of said first axial section that has been already covered.

22. The process according to claim 15, wherein said strips of double-sided adhesive tape whose length is substantially equal to the outer circumference of said sleeve are obtained by:

unwinding the double-sided adhesive tape of a roll of double-sided adhesive tape, which is rotatably supported by said apparatus, and transversely cutting the double-sided adhesive tape unwound from said roll and selectively fed and guided to the surface of said first sleeve, using cutting means of said apparatus.

23. The process according to claim 22, comprising detecting a presence of a section of double-sided adhesive tape unwound from said roll and selectively fed and guided to the surface of said first sleeve before said double-sided adhesive tape contacts said first sleeve, to increase accuracy of detection of the tape section being carried.

24. The process according to claim 22, wherein:

said double-sided adhesive tape comprises an anti-adhesive protective film applied to one side of said double-sided adhesive tape to prevent contact between overlapping turns of double-sided adhesive tape in said roll, and said apparatus comprises means for removing said anti-adhesive protective film from said side of said double-sided adhesive tape, comprises removing said anti-adhesive protective film from said side of said double-sided adhesive tape:

during unwinding of said double-sided adhesive tape from said roll, before said double-sided adhesive tape contacts the surface of said first sleeve supported in said workstation, or at the same time as said double-sided adhesive tape is applied to the surface of said first sleeve supported in said workstation, said process comprising a step of rolling said anti-adhesive protective film removed from said side of said double-sided adhesive tape around a winding roller.

25. The process according to claim 15, wherein said apparatus further comprises:

a support surface having a top side upon which a first photopolymer to be applied to said sleeve supported in said workstation is designed to be positioned, said support surface having, defined therein:

a loading area whereat said first photopolymer is initially positioned for detection; and an unloading area wherefrom said first photopolymer is directed toward said first sleeve supported in said workstation, and said unloading area being distal from said loading area;

first handling means for moving and orienting said first photopolymer on said support surface from said loading area to said unloading area; and first detection means for detecting a presence of a photopolymer at said loading area of said support surface and for detecting the position and orientation of said photopolymer at said support surface, said process further comprising:

positioning a first photopolymer in said loading area of the support surface;

detecting the position and orientation of said first photopolymer on said support surface in said loading area, using said first detection means;

according to the detected position and orientation of said first photopolymer on said support surface in said loading area, calculating the translational and rotational components to be imparted to said first photopolymer, by said first handling means, to displace said first photopolymer from said loading area to said unloading area with predetermined orientation and position for proper application thereof to said first sleeve;

by means of first control means, controlling the actuation of said first handling means and displacing said first photopolymer from said inlet area to said unloading area of said support surface according to translational and rotational components so calculated, and directing said first photopolymer from said unloading area of said support surface to the outer surface of said first sleeve supported in said workstation.

26. The process according to claim 25, wherein:

said step of displacing said first photopolymer from said inlet area to said unloading area of said support surface, according to the translational and rotational components so calculated, is carried out without checking or verifying the position of the photopolymer in said unloading area of said support surface before directing it to said first sleeve, and said step of directing said first photopolymer from said unloading area of said support surface to the outer surface of said first sleeve supported in said workstation, during application to said first sleeve, is carried out without checking or verifying the position of the photopolymer.

27. The process according to claim 25, wherein:

said first control means for controlling the actuation of said first handling means comprise:

angular encoders with an accuracy of one thousandth of a degree for determining the instantaneous angular position of said first handling means relative to an axis of rotation perpendicular to said support surface, and linear encoders with an accuracy of one micron for determining an instantaneous position of said first handling means relative to said support surface, and said step of controlling the actuation of said first handling means and displacing said first photopolymer from said inlet area to said unloading area of said support surface according to the translational and rotational components so calculated is carried out by controlling:

with an accuracy of one thousandth of a degree an instantaneous angular position assumed by said first handling means relative to an axis of rotation perpendicular to said support surface, and with an accuracy of one micron the instantaneous position assumed by said first handling means relative to said support surface.

28. The process according to claim 25, wherein said first handling means for displacing said photopolymer contact said first photopolymer laying flat on said support surface from above and exert a suction action on said first photopolymer to become joined with said first photopolymer and cause the latter to be jointly displaced on said support surface.

29. The process according to claim 25, wherein:

said apparatus comprises suction means and said support surface comprises suction holes formed in said support surface, open at the top side of the support surface and in fluid communication with said suction means, and said step of detecting the position and orientation of said first photopolymer on said support surface in said loading area, using said first detection means is preceded by a step of laying said first photopolymer on the top side of said support surface, by means of suction.

30. The process according to claim 25, wherein:

said apparatus comprises blowing means and said support surface comprises blowing holes formed in said support surface, open at the top side of the support surface and in fluid communication with said blowing means, and said step of displacing said first photopolymer on said support surface from said inlet area to said unloading area is carried out during a step in which air is blown from said blowing holes of the support surface, to reduce the friction of said first photopolymer on the top side of said support surface.

31. The process according to claim 25, wherein said step of detecting the position and orientation of said first photopolymer on said support surface is carried out by:

a first step of detecting the edge of said first photopolymer located in said inlet area of the support surface, and a later step of detecting and reading one or more positioning and centering marks on said first photopolymer.

32. A process of preparing a flexographic printing sleeve using an apparatus, the process comprising:

A) providing a first flexographic printing sleeve having a preset axis;

B) providing strips of double-sided adhesive tape whose axial length is substantially equal to an outer circumference of said sleeve;

C) providing an apparatus with a support structure comprising:

first support means, which defines a workstation for rotatably supporting said first sleeve such that said first sleeve can rotate about its preset axis;

first motor means associated with said first support means, for rotating said first sleeve supported in said workstation, about its axis;

D) rotating said first sleeve supported in said workstation about its axis, and

E) by means of first feeding and guiding means, selectively feeding and guiding said strips of double-sided adhesive tape to the surface of said first sleeve for circumferential application of said strips of double-sided adhesive tape to the outer surface of said first sleeve, such that:

each strip of double-sided adhesive tape defines a cover ring, said cover ring being coaxial with the axis of said first sleeve and being as wide as said double-sided adhesive tape, and at least one preset axial section of said first sleeve supported in said workstation is covered with one of said cover rings of double-sided adhesive tape or a succession of said cover rings of double-sided adhesive tape, arranged in juxtaposed relationship along the axis of said sleeve, before removing said first sleeve from said workstation, the process further comprising:

checking, at said workstation, proper positioning of one or more photopolymers on the outer surface of said first sleeve using third detection means, and checking whether the position of said one or more photopolymers applied to the outer surface of said first sleeve falls within the positioning range that has been set for each photopolymer, to determine whether said first sleeve is suitable for a later flexographic printing step.

* * * * *